US009346644B2

(12) United States Patent
Kudrus

(10) Patent No.: US 9,346,644 B2
(45) Date of Patent: May 24, 2016

(54) DEVICE AND METHOD FOR PRODUCING AND OPTIONALLY DISPATCHING FLAT ARTICLES, IN PARTICULAR DOCUMENTS OR PRINTED MATTER

(75) Inventor: Heiner Kudrus, Augsburg (DE)

(73) Assignee: iKudrus GmbH, Padenstedt (DE)

( * ) Notice: Subject to any disclaimer, the term of this patent is extended or adjusted under 35 U.S.C. 154(b) by 0 days.

(21) Appl. No.: 14/236,389

(22) PCT Filed: Aug. 1, 2012

(86) PCT No.: PCT/DE2012/000773

§ 371 (c)(1),
(2), (4) Date: May 8, 2014

(87) PCT Pub. No.: WO2013/017122

PCT Pub. Date: Feb. 7, 2013

(65) Prior Publication Data

US 2014/0312564 A1 Oct. 23, 2014

(30) Foreign Application Priority Data

Aug. 1, 2011 (DE) ..... 10 2011 108 986.5

(51) Int. Cl.

| | |
|---|---|
| ***B65H 29/00*** | (2006.01) |
| ***B41J 3/44*** | (2006.01) |
| ***B41J 13/12*** | (2006.01) |
| ***G07B 17/00*** | (2006.01) |

(52) U.S. Cl.

CPC . *B65H 29/00* (2013.01); *B41J 3/44* (2013.01); *B41J 13/12* (2013.01); *G07B 17/00508* (2013.01); *G07B 2017/00516* (2013.01)

(58) Field of Classification Search

CPC ..... B41J 3/44; B41J 3/12; G07B 17/00; G07B 17/00508; G07B 2017/00516; B65H 29/00

See application file for complete search history.

(56) References Cited

U.S. PATENT DOCUMENTS

| | | | | |
|---|---|---|---|---|
| 6,732,152 | B2 | 5/2004 | Lockhart et al. | |
| 7,265,853 | B1 * | 9/2007 | Kara et al. | 358/1.15 |
| 2003/0222396 | A1 * | 12/2003 | Kurahashi | B42C 19/02 271/207 |
| 2007/0063037 | A1 * | 3/2007 | Silverbrook et al. | 235/432 |
| 2007/0263019 | A1 * | 11/2007 | Furukawa et al. | 347/5 |
| 2010/0143017 | A1 * | 6/2010 | Christenson et al. | 400/621 |
| 2011/0100238 | A1 | 5/2011 | Caudle | |

FOREIGN PATENT DOCUMENTS

CN 1533904 A 10/2004

OTHER PUBLICATIONS

Chinese Office Action of Chinese Application No. 201280048334.5, mailed May 6, 2015 with English translation.

International Search Report of PCT/DE2012/000773, mailed Oct. 22, 2013.

* cited by examiner

*Primary Examiner* — David H Bollinger

(74) *Attorney, Agent, or Firm* — Collard & Roe, P.C.

(57) ABSTRACT

A device for producing and dispatching documents includes an electronic order processor and a processing machine controlled by the electronic order processor. The processing machine includes a printing machine and a mechanical dispatch preparation device. In order to permit a greater degree of individuality for documents generated in this manner, a locally effective document preparation device is arranged between the printing machine and the mechanical dispatch preparation device.

24 Claims, 35 Drawing Sheets

704

712

714

716

718

720

DEVICE AND METHOD FOR PRODUCING AND OPTIONALLY DISPATCHING FLAT ARTICLES, IN PARTICULAR DOCUMENTS OR PRINTED MATTER

CROSS REFERENCE TO RELATED APPLICATIONS

This application is the National Stage of PCT/DE2012/000773 filed on Aug. 1, 2012, which claims priority under 35 U.S.C. §119 of German Application No. 10 2011 108 986.5 filed on Aug. 1, 2011, the disclosure of which is incorporated by reference. The international application under PCT article 21(2) was not published in English.

The invention relates on the one hand to a device for creating and sending flat articles, especially written documents or printed matter, with an electronic order processing system and with a processing machine, which is activated by the electronic order processing system and which comprises a printing machine and a mechanical sending preparation system. The invention also relates to a device for creating and sending flat articles, especially written documents or printed matter, with an electronic order processing system and with a processing machine, which is activated by the electronic order processing system and which comprises at least two processing devices, wherein an interface is disposed between the electronic order processing system and a customer. Likewise the invention relates to a method for creating and sending flat articles, especially written documents or printed matter, in which flat articles are generated in at least one mail center on the basis of electronic order data records, prepared to be ready for sending and then sent, and customers are able to deliver electronic order data records to the mailing center via an interface, or a method for creating flat articles, especially written documents or printed matter.

Such devices and methods for creating and sending flat articles are sufficiently known from the prior art and are used especially in large companies but also in corresponding service centers for automated generation of written documents by means of conventional printing machines, which guide and print an appropriate paper to be printed through a printing mechanism, for example comprising at least two oppositely disposed cylinders, as well as for sending same, wherein the paper is additionally prepared for sending in correspondingly suitable folding mechanisms and inserting machines, i.e. a mechanical sending preparation system.

It is also known to link such processing machines comprising a printing machine and a mechanical sending preparation system with an electronic order processing system, so that not only form letters but also individual letters, for example of individual departments of a company but also of individual persons, such as of individual customers, for example, can be recorded as orders and be prepared to be ready for sending by the processing machines.

In this connection it must be explained that the expression "flat articles" is to be understood as a generic term for "flat pieces" as well as "envelopes" and "flat items" to be inserted into envelopes. In this respect, "flat pieces" correspond to the "flat items", although the latter are still inserted before sending, which is not provided for the former. "Flat items" or "flat articles" may in particular be documents, enclosures or even cards.

However, such devices and methods have the disadvantage that flat articles generated, therewith permit only a small degree of individuality and the corresponding flat articles can always be recognized as printed works or as flat articles or printed matter created by machine and without any human involvement. It is therefore the task of the present invention to minimize this disadvantage.

Methods or devices with the features of the independent claims are proposed as the solution. Further advantageous configurations are presented in the dependent claims but also in the present description.

In this respect, a device for creating and sending flat articles with an electronic order processing system and with a processing machine, which is activated by the electronic order processing system and which comprises a printing machine and a mechanical sending preparation system, may be characterized in that the printing machine includes a locally active written document preparation system is disposed between the printing machine and the mechanical sending preparation system.

The locally active written document preparation system permits a high degree of individualizability of a written document, which is generated on the printing machine. This individualizability is permitted by an additional processing of the written document, which normally cannot be done on, the printing machine. For example, this may be further printing operations, such as the local embossing of a stamp, or mechanical processing, such as local cutting operations, on or of the written document, which accordingly prepare a written document locally.

Alternatively or cumulatively, a device for creating and sending written documents with an electronic order processing system and with a processing machine, which is activated by the electronic order processing system and which comprises a printing machine and a mechanical sending preparation system, may also be characterized in that a stationary written document preparation system is disposed between the printing machine and the mechanical sending preparation.

Here also a high degree of individualizability is possible, wherein the stationary written document preparation system is able to perform complex writing and processing operations, which are not available by means of the conventional printing machine and the mechanical sending preparation system or by means of the processing machines known from the prior art and comprising printing machine and mechanical sending preparation system.

Both of these foregoing configurations arise from the common basic idea according to the invention of providing, for individualization, in a machine environment or process controller designed inherently for high throughput, as is represented in particular by a mechanical sending preparation system, which are loaded with the finished flat articles from the printing machine, especially also mechanically, i.e. without manual intervention, and are subject to an electronic order processing system, an inherently very slow process step, namely a stationary residence of the flat articles to be processed or a written document preparation system that is active only locally, i.e. is active only at individual points. Such locally active and/or stationary written document preparation systems are inherently known, for example, as automatic signature machines or else as plotters. As a rule, however, these are loaded by hand or manually and therefore are not used in environments according to the preamble. In particular, their incorporation in a machine working process, for example in connection with traveling endless paper, which is mechanically written and then separated in appropriate formats, or in connection with mechanical sorting, inserting or other paper processing installations, is not known from the prior art.

A "written document" in the present context is the physical form of a message, which regularly exists in paper form. Thus a written document may be a letter, a flyer, a postcard, business cards or similar forms or a message or of an information medium. As is immediately obvious, a written document is not exclusively restricted to the paper form. Thus it is also possible to produce a written document from other substances, such as from plastics or textiles, for example.

This "electronic order processing system" consists of any kind of hardware or software, by means of which order data for creating a flat article, especially a written document or a printed matter, or data about the flat article or about the written document itself, can be received, modified, allocated or sent. In this respect, the same applies for all incidental information about an order, a flat article or a printed document, inasmuch as customer data, invoice data or recipient data are attached to the order. An electronic order processing operation is to be understood not exclusively as an automatic routine, which is executed by computer, server or router, but also as any manual intervention on the order data or on the written document. In this respect the electronic order processing operation may also include interventions by an operator, a typesetter, a copywriter or a bookkeeper.

A "processing machine" activated by the electronic order processing system relates here to a machine, but also a network of individual machines, which can perform real processing or the creation of the physical written document on the written document cited in the order. In this respect, a processing machine does not have to comprise exclusively a printing machine and a mechanical sending preparation system. It is also conceivable that paper machines, sorting machines, franking machines or any machines equipped with a tool can be contained in the processing machine.

In the present connection, the expression "sending" comprises in particular a sending preparation system. The actual sending operation may absolutely comprise further method steps, which may be performed manually or semi-manually, for example, and in themselves do not absolutely have to be performed each time, such as, for example, sorting by hand, collecting several flat articles into transport boxes or placing in a mailing slot. In the present connection, the expression "sending" necessarily comprises only the sending preparation operation, insofar as the flat article can be delivered and sent, for example in its size or in its shape and adequately addressed. In the present context, the expression "sending" therefore denotes the final operation of preparing a flat article, in such a way that it can be transported as intended.

The "printing machine" relates to any devices that can apply typed script, graphics or other characters and symbols on a written document or can introduce them into a written document and in the present context are combined under the expression "printing devices". In general, a "printing machine" relates to any kind of device which, in addition to the application of dye, can also achieve a graphic design of the workpiece with tools. In particular, the expression printing machine obviously covers printers of any kind, such as, for example, laser printers, ink jet printers, plotters and the like. Also, several printing devices can be provided in series or in parallel with one another, and then as a whole form the printing machine.

In this respect the printing machine can comprise a further printing device, wherein it is then especially of advantage if the locally active and/or stationary written document preparation system is disposed between the further printing device and the mechanical sending preparation system. Preferably the further printing device is a globally active or continuously operating printing device, such as, for example, a laser printer or even an offset printer. In this way written documents can be prepared quickly and in conventional manner via the further printing device and then individualized in the locally active and/or stationary written document preparation system.

It will be understood that the one or any other further printing device may also be provided if necessary downstream from the locally active and/or stationary printed document preparation system, in which case it should then be ensured, however, that, for example, any seal is not damaged by the downstream further printing device and—as the case may be—any original document character of the written document produced in this way is not falsified.

In contrast to a graphical design of a written document by means of a printing machine, a "mechanical sending preparation system" relates to any devices for preparation of a written document for the subsequent sending. Thus these may be machines for folding, inserting or franking, for example. Likewise, enclosure feeders or cutting devices may also be provided. In this connection it must be remarked that a letter envelope used for sending the written document may be processed not exclusively by the mechanical sending preparation system but also by a printing machine, in order, for example, to apply address data or advertising on the envelope.

The basic idea already mentioned in the foregoing, of providing, in a machine environment or process controller designed inherently for high throughput, which are loaded with the finished flat articles from the printing machine, especially also mechanically, i.e. without manual intervention, and are subject to an electronic order processing operation, an inherently very slow process step, can be implemented in particular when the printing machine and the mechanical sending preparation system have allocating means for the allocation of a flat article to a specific order. This can be achieved, for example, by an appropriate control code or integrity control code, which is applied on the flat article and if necessary later removed again. A bar code but also an address may be used as such a control code, for example, if suitable image recognition means are provided that permit appropriate allocation from the control code or from the address. Cumulatively or alternatively to this, the device may even ensure an appropriate allocation by the fact that every flat article that passes through the device is individually known, so that an exact allocation may be made at any time up to the sending preparation operation.

Depending on specific process control, especially the integrity with respect to a flat article can be ensured up to the sending preparation operation by such an allocating means, so that the said article, for example when it is a flat item, can also be inserted specifically into a correct envelope and as the case may be also combined with necessary enclosures. For example, an invitation to a general meeting may be machine-written or at least machine-signed, in which case even various signatures may be represented if necessary with different tools and provided with an annual report as an enclosure. By the allocation, an individual envelope, i.e. a windowless envelope may then be used with individual addressing, in which case the envelope may also be machine-inscribed if necessary, processed with a tool that can move in at least two dimensions but is active substantially one-dimensionally and/or subjected to processing by a locally active and/or stationary written document preparation system, in order in this way to emphasize the individual character of the entire flat article comprising envelope as well as flat items, or document and enclosure.

Accordingly, especially the allocating means permit a switch from a hand-operated process, in which especially a great susceptibility for errors also exists, when an automatic signature machine has to be appropriately loaded and the cover letter then inserted by hand, to a machine process, in which on the one hand a high number of pieces can be processed and on the other hand a low susceptibility to errors can be ensured.

A "written document preparation system" represents a subgroup of a printing machine or printing device, but it is designed only for a processing operation on the flat article by means of a tool.

A "tool" within the meaning of the invention may be, for example, a stamp, a pen, a knife, a spraying device, an embossing device or any further tool controlled by a tool control system.

A "tool control system" is consequently any device that is able to control a tool in a desired, i.e. in an individualizable or programmable manner and way for processing the flat article or the written document.

An advantageous configuration of the device described in the foregoing is achieved when the written document preparation system comprises a vectorially activated tool control system. The high degree of individualizability is achieved by the possibility of configuring the tool control system programmably, whereby a multidimensional processing operation among other options can be carried out on the written document. In contrast to a printing machine, which composes a script pattern or a pattern from several approximately zero-dimensional individual dots, a cohesive pattern, for example comprising two-dimensionally drawn symbols or graphics, can be generated. In particular, signatures or even brush lines can be used accordingly as the individualizing feature during the written document preparation operation, since movement sequences, especially the movement sequences of a stylus, a brush or a knife, for example, can be predetermined particularly simply by a vectorially activated tool control system.

The same advantages as a vectorially activated tool control system provides are achieved by a further advantageous configuration of the device described in the foregoing, wherein the written document preparation system comprises a three-dimensional tool control system. While renouncing the vectorially activated tool control system, a much more complex processing operation on a written document is possible hereby, for example by the fact a different pressing pressure is or can be predetermined for a brush or a different setting angle of the respective tool for styluses and brushes. In this connection it will be understood that even a vectorially activated tool control system is limited not merely to a two-dimensional processing operation but may be likewise used for a three-dimensional processing operation. This may then lead, for example, to a different pressing pressure, which—depending on the specific application situation—leads, for example, to permanent deformation of the paper or any other flat article and therefore to the typical character of a flat article inscribed by hand, or else to different brushing thicknesses.

It is particularly advantageous for a device according to the invention with a three-dimensional tool control system when a substantially one-dimensionally active tool, for example a stylus, a brush, a pen, a knife, a spray head and/or a stamp is disposed on the three-dimensional tool control system.

In this connection, the expression "one dimensional" is to be interpreted mathematically, since naturally any of the tools mentioned in the foregoing generates an at least two-dimensional script pattern and has a three-dimensional extent. It is also to be pointed out in this connection that a spray head does not have to be exclusively a spray head of an ink jet printer, but in this connection may also be any pulse-actuated or pneumatically actuated tool, such as an airbrush spray gun, for example.

In particular, it is advantageous for a device according to the invention—even alternatively to a three-dimensional tool control system—when the written document preparation system comprises an embossing station. By means of an embossing station, but also by means of a device for punching, a three-dimensional configuration of the flat article or of the written document can be achieved, in which case, as already explained in the foregoing, even the feel of the written document can be advantageously configured in addition to the visual perception.

Furthermore, it is advantageous for a device according to the invention when a picture recording system is disposed in the area of the written document preparation system or in front of it or behind it. A picture recording system, for example a camera with a corresponding software, is able to check the created written documents for the performed tasks while they are still undergoing the processing operation or immediately thereafter and to adapt the necessary number of written documents to be processed appropriately, if written documents have to be sorted out for lack of quality.

In particular, such a camera offers the possibility that customers can review the quality of their written documents directly themselves, by the fact that the customer is granted appropriate access to the respective pictures that belong to the written documents of these customers. Such a check is of considerable advantage especially for very highly individualized operations, such as a brush stroke or a signature, since hereby trust can be established.

Furthermore, a camera is able, cumulatively or alternatively to this, to use control codes, especially integrity control codes, but also areas used as control codes, such as, for example, an address field, to record a flat article and then to extract information therefrom for the ensuing process step. On the one hand, this can be done directly, by the fact that information about the tool to be used, whether it be, for example, a brush, or whether it be, for example, a pen, and/or the sequence of the processing operation, such as, for example, the writing of a signature or of a symbol, is contained directly in a control code, in which case the corresponding machine commands are then generated in the processing device itself via a database. On the other hand, this can be done indirectly, by the fact that a corresponding allocation to an order takes place from the control code or the address, by the fact that the corresponding information is then saved.

In this respect it will be understood that such a picture recording system in, upstream from or downstream from the printing machine, whether it be merely a still picture system or whether it be even a running picture monitoring system, is correspondingly advantageous even independently of the other features of the present invention in a device for creating and sending flat articles or written documents with an electronic order processing system and with a processing machine, which is activated by the electronic order processing system and which comprises a printing machine and a mechanical sending preparation system, especially when a check by a customer is enabled, for example in real time or by access to sent or archived images.

Furthermore, it is advantageous for a device according to the invention when the written document preparation system has at least two identically constructed processing stations or processing devices and a distributor is disposed between the printing machine and the two processing devices or processing stations. A written document preparation system that has a smaller throughput than a printing machine connected upstream from the written document preparation system will not be able, because of the configuration explained in the foregoing, to attain the maximum capacity usage of the printing machine regularly. Therefore a processing operation on the written document by means of two or more processing devices or processing stations is advantageous on the one hand for rapid processing of all requested written documents and on the other hand is advantageous for the capacity usage of the respective printing machine. Above and beyond this, a different processing operation is also possible when, for example, two written documents that are associated but are to be individualized differently are generated in a common printing machine. Thus, for example a first page of a letter or document can be provided with a dyed logo of a company, whereas a last page of a letter or document can be provided with a signature and a seal stamp.

Accordingly, what is also advantageous independently of the other features of the present invention, is a device for creating and sending flat articles, especially written documents or printed matter, with a processing machine, which is activated by the electronic order processing system and which comprises at least two processing devices or stations, which device is characterized in that the two processing devices or stations are respectively identical and/or are two different locally active and/or stationary written document preparation systems. Hereby it is possible to perform different tasks on the one hand but also similar tasks simultaneously, so that the entire device operates faster as a result.

These two identical locally active and/or stationary written document preparation systems can in particular be activated in dual stream mode, whereby correspondingly double processing speeds can be attained.

Between an entry and the two processing stations, it is possible in particular to dispose a distributor, which allocates the individual flat articles respectively to the one or the other written document preparation system. If necessary, however, especially when the medium that actually represents the flat article, such as, for example, the paper, can also be separated subsequently, the dual-stream or multiple-stream mode can also be implemented by the fact that a corresponding larger, quasi endless flat article is first processed in dual-stream or multiple-stream mode and only then appropriately separated.

In this respect it is also possible in particular to configure the device for creating flat articles in such a way that the written document preparation system or systems operates or operate on endless paper, which is then severed at another location. The latter may also be done if necessary on a separate installation, by the fact that the endless paper is again rolled up downstream from the written document preparation system, transported to a separate installation and there unrolled again and processed. In particular, in such a configuration, it is also possible, during the separation operation, to remove a control code applied on the endless paper, if the necessary integrity, meaning sufficient correlation of the individual flat article to an order, is ensured during and after the separation operation.

Whereas a "distributor" is any device for directing the written documents emerging from the printing machine to the respective processing station, the expression "processing station" denotes any subunit of a written document preparation system in which a processing step can be executed.

Accordingly it is of advantage when the two processing devices or processing stations have a common entry and/or a common exit. Hereby a transition to mass production on the machine scale can be assured in particularly simple manner.

Alternatively or cumulatively, in order to accomplish the task posed in the introduction, a device for creating and sending flat articles, especially written documents or printed matter, with an electronic order processing system and with a processing machine, which is activated by the electronic order processing system and which comprises at least two processing devices, wherein an interface is disposed between the electronic order processing system and a customer, can be characterized in that the interface contains a parameter matrix with at least two parameter vectors, wherein the first of the two parameter vectors includes parameters for a first processing instruction for the flat article or the written document and the second of the two parameter vectors includes parameters for a second processing instruction for the flat article or the written document.

Herewith, via the interface, it is also advantageously possible, for a customer in particular, to write several processing instructions for the written document to be created and to activate or cause to be activated the various processing devices of the processing machine separately according to his or her own wishes, in order to individualize the written document in this way.

In this connection this approach in particular likewise permits the basic idea according to the invention of individualizing a bulk transaction, since through the interface anyone is ultimately enabled to influence a printing operation individually, which heretofore was not provided in devices for creating and sending written documents with an electronic order processing system and with a processing machine, which is activated by the electronic order processing system, which devices, with the exception of the processing of the actual printing template, for example in an appropriate file format, permit only interventions by specially trained personnel or by the respective machine operator.

In this connection the interface can also be constructed in particular in such a way that an appropriate access is possible via modern communications devices, such as, for example, computers, tablets or smartphones, thus on the one hand permitting a use for the mass production but also a very individual design of the respective flat articles. In this connection it is ultimately immaterial to the machine running in mass production whether an individual flat article is produced in extremely individualized condition and in only one copy or as part of a large order is produced in numerous or thousands of copies, if necessary only with marginal individualization.

In particular, the parameters may contain processing instructions for a script, for a watermark, for a stamp, for an embossing, for a punching, for a fragrance, for pictures or for advertising. These various processing instructions, which can be executed by various processing devices, may therefore be selected by the customer and allocated to the written document individually via the interface, and therefore, for example, by computers, tablets or even smartphones. In the prior art heretofore, the creation and allocation of the respective processing instructions have usually been done by the order processing system, which autonomously activates the processing devices responsible for the respective instruction.

In particular, such an interface makes it possible to supply orders containing all customer parameters necessary for printing directly to the order processing system, so that such devices operating in highly automated mode can be made economically available for the first time even to customers with smaller printing runs. For large customers, a high degree of individualization is not necessary as a rule, and so this can be done by direct interventions, for example of an agent of the operator or provider of the device for creating and sending written documents.

As the "processing device" in the present sense there will be understood a subunit of the processing machine that for its part may have several processing stations. Thus, for example, a processing device of a processing machine may be an embossing station, wherein several processing stations of this processing device perform various embossing operations, for example. In this respect the processing stations as well as the processing devices are preferably the aforesaid printing devices, although subassemblies of the mechanical sending preparation system or other units may accordingly be processing stations or devices.

The "interface" denotes a link from the processing machine or the electronic order processing system to an external system, by means of which the processing machine can be activated. This external system is preferably a customer, who prepares the order data or the written document with all necessary parameters for the purpose in his or her office and is able to transmit these via a network, for example via the Internet, by means of the interface to the electronic order processing system. Accordingly, the interface, with appropriate operating clearance, also permits downloading of data input by a customer using computers, tablets or smartphones or using similar modern communications devices.

In this respect the "parameter matrix" preferably includes all relevant data of the transmitted order or of the flat article or of the printed document, so that, as far as possible, further interventions by operating personnel, such as, for example, by an agent of the corresponding provider, are not necessary or are reduced to a minimum. This parameter matrix, which may also be a multidimensional matrix, includes, inasmuch as the respective data are sorted in some manner and way, parameter vectors, which in turn contain parameters for the respective processing instructions. A parameter vector therefore preferably includes all relevant data of an individual processing device. The interaction of all parameter vectors in the parameter matrix leads to the complete definition of the flat article cited in the order or of the written document cited in the order, which article or document can be created in the processing machine by the individual processing devices activated by the parameter vectors. It is immediately obvious that any parameter vector may in turn also contain parameter vectors, and so the designation of "vector" is not reserved exclusively for a one-dimensional data space. In this respect, a "parameter matrix" may in particular also contain a multidimensional data space.

By means of the definitions explained in the foregoing, a "processing instruction" preferably includes, as is immediately obvious, the information for an individual processing device that is necessary for processing the flat article or the written document.

In a further configuration of the device according to the invention, it is advantageous when the two parameter vectors have at least one different processing instruction for various processing steps. In this connection an advantageous effect is achieved when various processing devices are able to execute several different processing steps on one and the same flat article or on one and the same written document, since the various processing steps can also be executed by various tools.

In this connection it is particularly advantageous when the various processing steps are printing instructions. In this respect a flat article or a written document is printed by various steps or by various applications. It must be remarked that a "printing instruction" in the present context may also include in particular the processing of a written document by mans of a stamp, a pen, a knife, an embossing system or else a punching system, in which case a text to be printed or a picture to be printed is placed if necessary in a single coordinate of the parameter vector or of the parameter matrix.

In connection with a device for creating and sending flat articles or written documents that has an interface with a parameter matrix, it is further advantageous when the first of the two parameter vectors has processing instructions for the activation of the first of the two processing devices and the second of the two parameter vectors has processing instructions for the activation of the second of the two processing devices. As is immediately obvious and as has already been explained in the foregoing, this configuration enables the separate activation of the respective processing device on the part of the customer, who autonomously selects and defines the processing steps necessary for the creation of the flat article or of the written document.

Above and beyond this, a method for creating and sending flat articles, especially written documents or printed matter, in which flat articles, especially written documents or printed matter, are generated in at least one mail center on the basis of electronic order data records, prepared for sending and then sent, and customers are able to deliver electronic order data records to the mail center via an interface, can be characterized in that a flat article or a written document is processed in the mail center with a substantially one-dimensionally active tool capable of movement at least in two dimensions.

This approach also follows the basic idea according to the invention of providing, with a tool that inherently conflicts with this basic idea and operates slowly and laboriously, an installation set up for large throughput, just as a mail center represents, which if necessary is even networked with further mail centers located at other sites or in other countries and as a rule is intended locally to print and insert bulk mail prepared centrally by a customer in large volumes and then send it locally at the lowest possible postage costs, in order in this way to permit a high degree of individuality as regards the respective flat articles or written documents. In this connection, a "mail center" is able to receive electronic order data records and relay them to a processing machine and above and beyond this either to include the necessary processing machine or else to relay the received order data to a further mail center that includes the corresponding processing machine.

This tool may be, for example, a stylus, a pen, a brush, a knife, a spray head and/or a stamp. Advantageously a high degree of individualizability in creating and sending flat articles or written documents is permitted by this method. This individualizability therefore arises from the fact that, with the tool being used, on the one hand creation of the flat article or of the written document can be achieved individually by virtue of the tool being used and on the other hand a further individualizability is possible by use of several different tools.

Alternatively or cumulatively to the foregoing method, a method for creating and sending flat articles, especially written documents or printed matter, in which written documents are generated in at least one mail center on the basis of electronic order data records, prepared for sending and then sent, and customers are able to deliver electronic order data records to the mail center via an interface, can be characterized in that the flat article or the written document is mechanically inscribed.

This method also advantageously accomplishes the task set in the introduction and implements the present basic idea, since mechanical inscription of flat articles or written documents precisely for individual flat articles or written documents that are specified externally has not been known heretofore. For bulk printed matter there are used either corresponding printing methods, such as offset printing methods, which do not permit any individualization at all, or laser printing methods, or inscription of the flat article or of the written document is done by a typewriter, for example using a daisy wheel or type ball, although because of the low processing speed, since indeed a typing operation is performed, this has not been used to date for bulk printing methods.

In this connection, therefore, a distinction must be made between a printing operation acting globally on a written document and a machine or mechanical typing operation, which takes place only one line at a time. Accordingly, precisely styluses or brushes or other pens in particular, which as already explained in the foregoing are moved mechanically in suitable manner, are suitable in particular for the machine or mechanical inscription.

Alternatively or cumulatively to the aspects explained in the foregoing, a method for creating and sending flat articles, especially written documents or printed matter, can be characterized in that the flat article or the written document is processed at least via two processing operations, of which at least one processing operation is a mechanical inscription operation, a processing operation with a substantially one-dimensionally active tool capable of moving at least in two dimensions or a processing operation with a locally active and/or stationary written document preparation system, before it is prepared for sending. In particular, these processing operations may be, for example a printing operation, a typing operation and/or a further processing operation. The advantage of the higher individualization is achieved in this case by the two processing steps, wherein customers are able to act on the written document both during printing of the text or selection of the text, but also during selection of further processing steps, such as, for example, stamping, embossing, addition of elements representing machine-written and especially a handwritten appearance or similar elements, in arbitrary combination.

Finally, in order to accomplish the task set in the introduction, a method for creating and sending flat articles, especially written documents or printed matter, in which flat articles, especially written documents or printed matter, are generated in at least one mail center on the basis of electronic order data records, prepared for sending and then sent, and customers are able to deliver electronic order data records to the mail center via an interface, can be characterized in that a flat article or a written document is processed in the mail center at least partly on non-moving paper. With this process control, complex typing, printing and processing operations can be advantageously executed on the non-moving paper. It is immediately obvious that this enables a likewise high degree of individualizability, since the selection of possible processing steps becomes larger.

It is further advantageous for the methods explained in the foregoing when the processing of the written documents upstream from the sending preparation system takes place at least partly in multiple-stream mode. By means of this configuration, the processing chain necessary for processing the written document is structured in such a way that processing steps that would slow the process sequence with regard to the preceding or subsequent processing steps are executed in parallel on several flat articles or written documents. To this extent, two flat articles or written documents arriving from a first processing step, for example, can nevertheless be subjected simultaneously to the subsequent processing in separate devices, when the subsequent processing step can be executed only considerably more slowly than the preceding step.

In order to be able to ensure in particular the operating safety and therefore the transition to mass production, it is of advantage when a flat article is allocated to an order in an electronic machine control system. This allocation can take place, for example, via a machine-internal assignment, by which it is ensured that the processing steps to be performed on a flat article are also performed on the correct flat article. Likewise a control code read out by the machine can be provided on the flat article, and corresponding integrity can be assured. If necessary, such a control code can be applied via a printing device, for example via a conventional printer. Likewise it may be applied by a locally active and/or stationary written document preparation system, in which case, however, it may be necessary to take suitable precautions to ensure that a control code applied by such written document preparation system, so that a control code with a stylus or with a brush, for example, can therefore be reliably recognized.

Preferably the control code is removed before the sending operation, which can be done, for example, in a cutting or separating operation, in which a border, which under certain circumstances is otherwise used as a guide for the flat article material, is cut off or in which two or more streams are separated from one another.

It will be understood that the features of the solutions described in the foregoing or in the claims may also be combined if necessary in order to be able to implement the advantages correspondingly cumulatively.

Further features, advantages, objectives and properties of the present invention, which may be advantageous independently or in combination with one another or with the features already explained in the foregoing, will be explained on the basis of the following description of exemplary embodiments, which in particular are also illustrated in the attached drawing, wherein.

Figure 1:
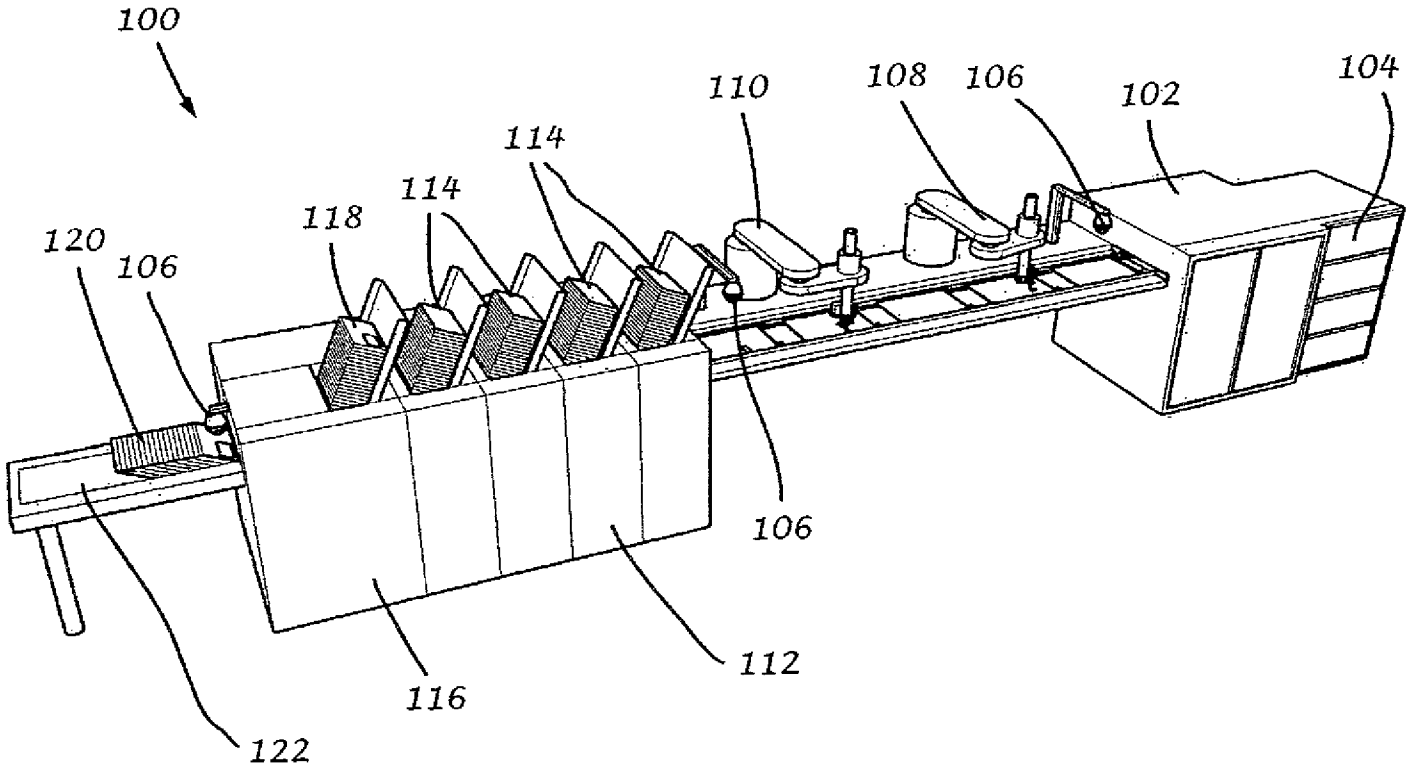
FIG. 1 shows a processing machine for creating written documents in overall view.

A processing machine 100 according to FIG. 1 has a paper supply 104 from which a printer 102 draws letter paper for creating a flat article or a written document. The printed paper, which is visually checked at an output of the printer 102 by means of a camera 106, is first fed to a cutting robot 108 and then to a writing robot 110.

Depending on the specific implementation of the invention, merely a check is performed by the camera 106. Likewise it is conceivable that a control code, which activates the processing machine 100 with respect, for example, to the selection of a tool or with respect to the selection of a particular ink, will be recorded via the camera.

Further processing of the written document with individualization defined on the part of the customer takes place at these two robots 108, 110. A further camera 106, which checks the result of the processing performed at these robots 108, 110, is in turn mounted downstream from the two robots 108, 110. The processed written document then proceeds first into an enclosure feeder 112 and thereafter into an inserter 116. The enclosure feeder 112 serves to enclose one or more enclosures 114 with the written document, if these have been purchase-ordered or requested on the part of the customer and/or a corresponding order, appropriately delivered, to an electronic order editing system has been input via an interface of the processing machine 100 yet to be explained hereinafter. The inserter 116 folds the finished written document together with the corresponding enclosures and inserts them in prepared envelopes 118. Written documents 120 ready for sending, which come to a standstill on a deposition belt 122 of the processing machine 100, are again visually recorded by means of a third camera 106 for the purpose of quality control downstream from the inserter.

Figure 35:
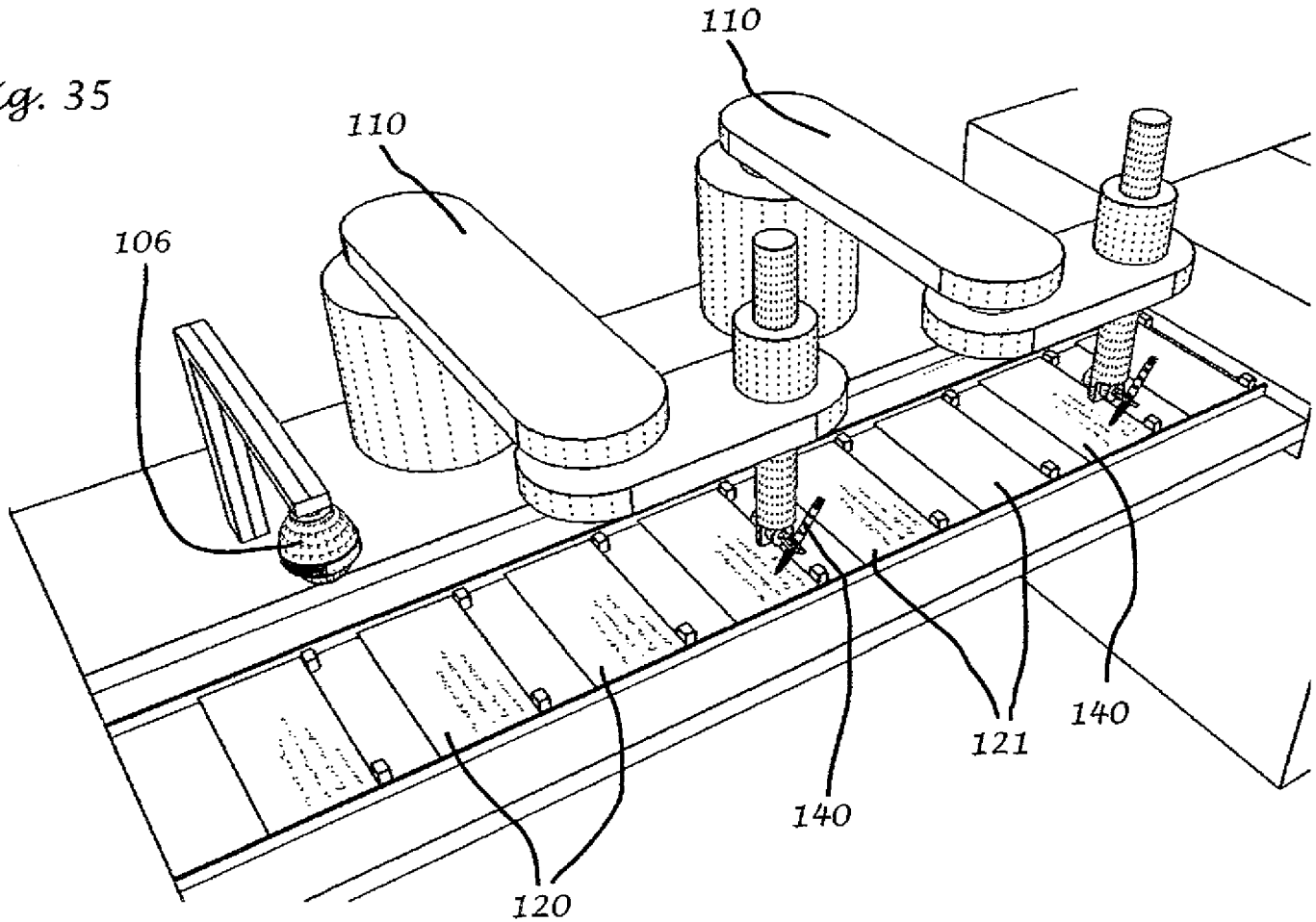
FIG. 35 shows a further detail view of the processing machine according to FIG. 33.

If necessary, as the exemplary embodiment according to FIG. 35 et seq. illustrates, the filled envelopes 121 may also be appropriately individualized, by passing these also to corresponding writing robots 110, in which case corresponding cameras 106 may also be provided here. In this respect both the envelope 121 and also the written document form flat articles, which can be appropriately individualized. In this connection, it will be understood that in one embodiment the envelopes may be appropriately processed separately, in which case the corresponding integrity should then be ensured under some circumstances, to the effect that the correct envelopes are being fed to the correct flat item. Likewise it is immediately conceivable that insertion will not be required in special configurations.

Figure 2:
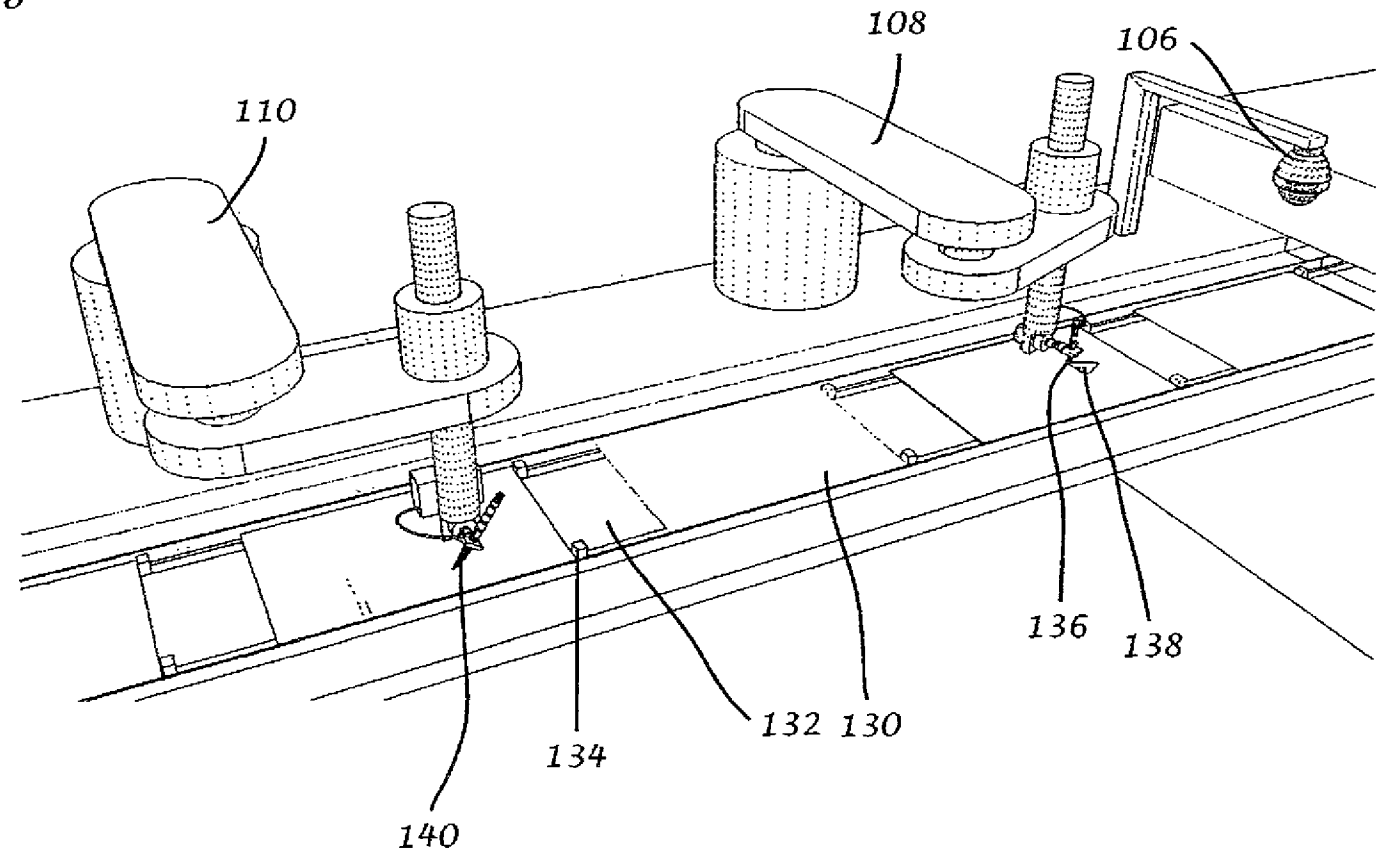
FIG. 2 shows a detail view of the processing machine according to FIG. 1 with a writing robot and a cutting robot.
Figure 3:
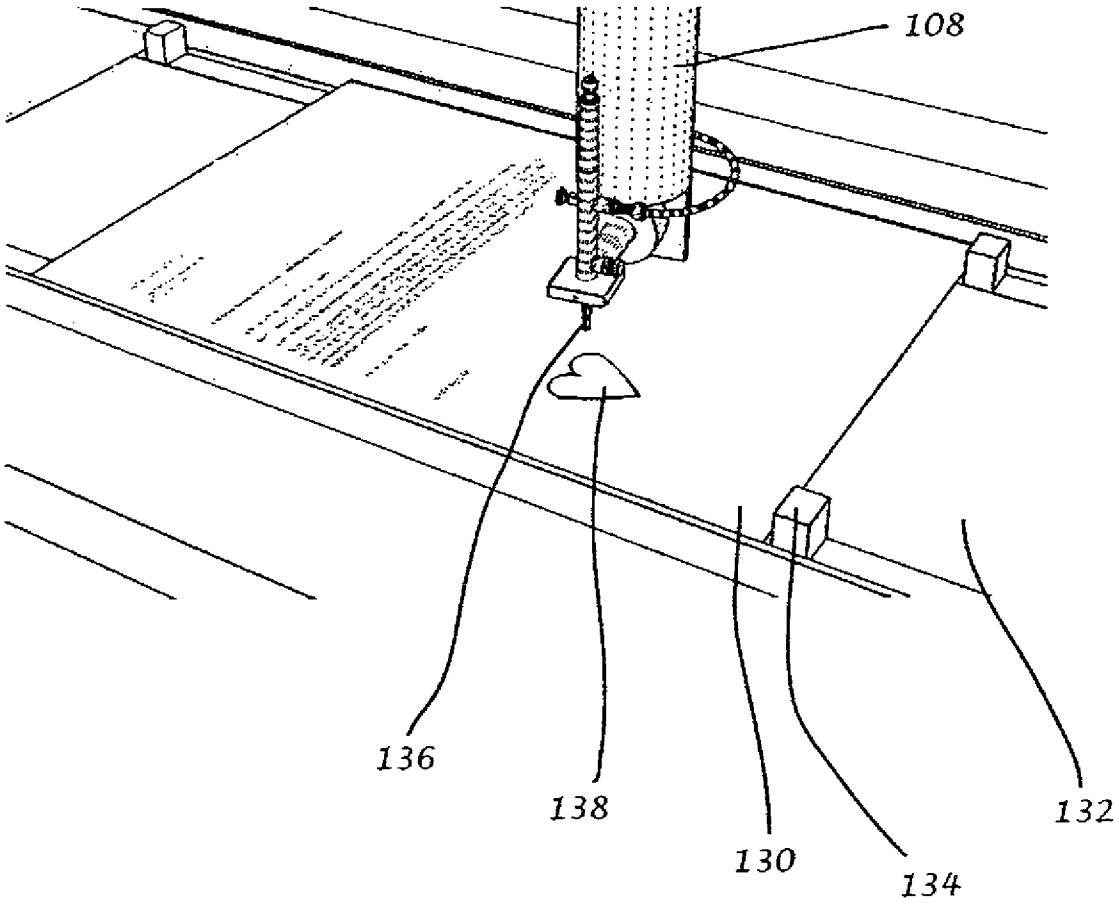
FIG. 3 shows a detail view of the cutting robot according to FIG. 2.
Figure 4:
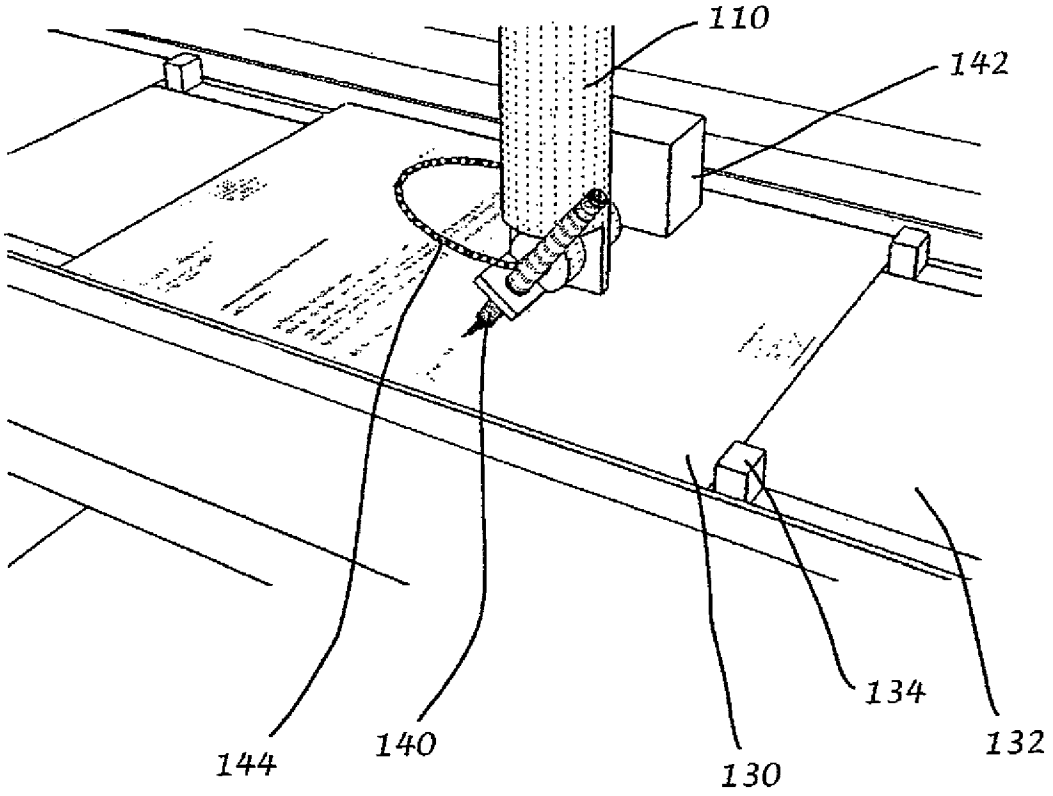
FIG. 4 shows a detail view of the writing robot according to FIG. 2.

According to FIGS. 2 to 4, the robots 108, 110 respectively have different tools for the processing of already printed letter paper 130. Thus the cutting robot 108 has a knife or a cutting head 136, by means of which a cutout 138 can be made in the letter paper 130. It is immediately obvious that a punching tool instead of the cutting head 136 may also be used to punch out the cutout 138. With a knife or a cutting head 136, however, the individual character of the processing operation can be enhanced, since punching tends to leave an impression of machine processing. Furthermore, a knife or cutting head 136 permits greater variability of the cut lines, which—as is true in any case for any substantially one-dimensionally active tool—likewise leads to increased individualizability.

Figure 36:
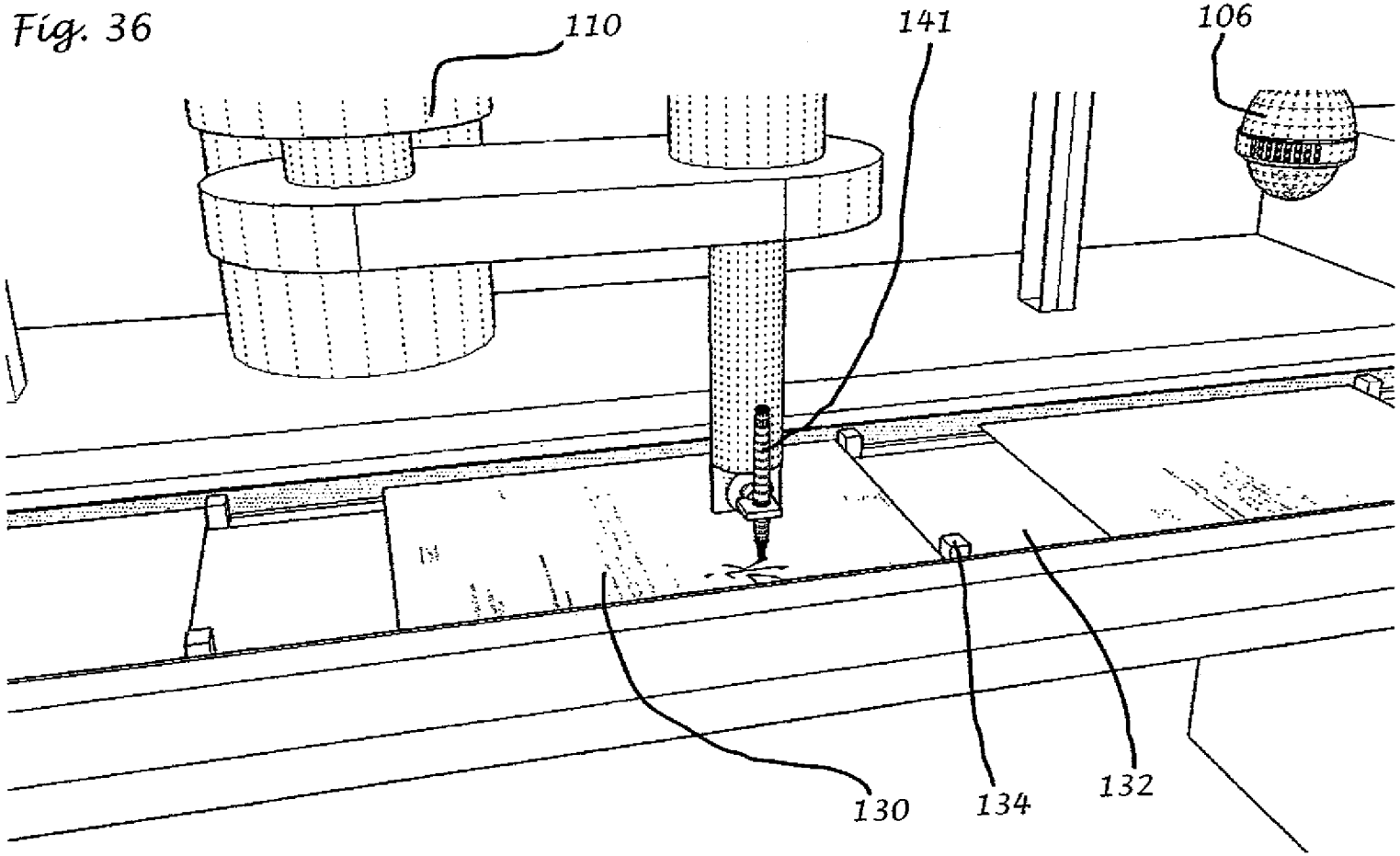
FIG. 36 shows a detail view of a further processing machine with a brush.
Figure 37:
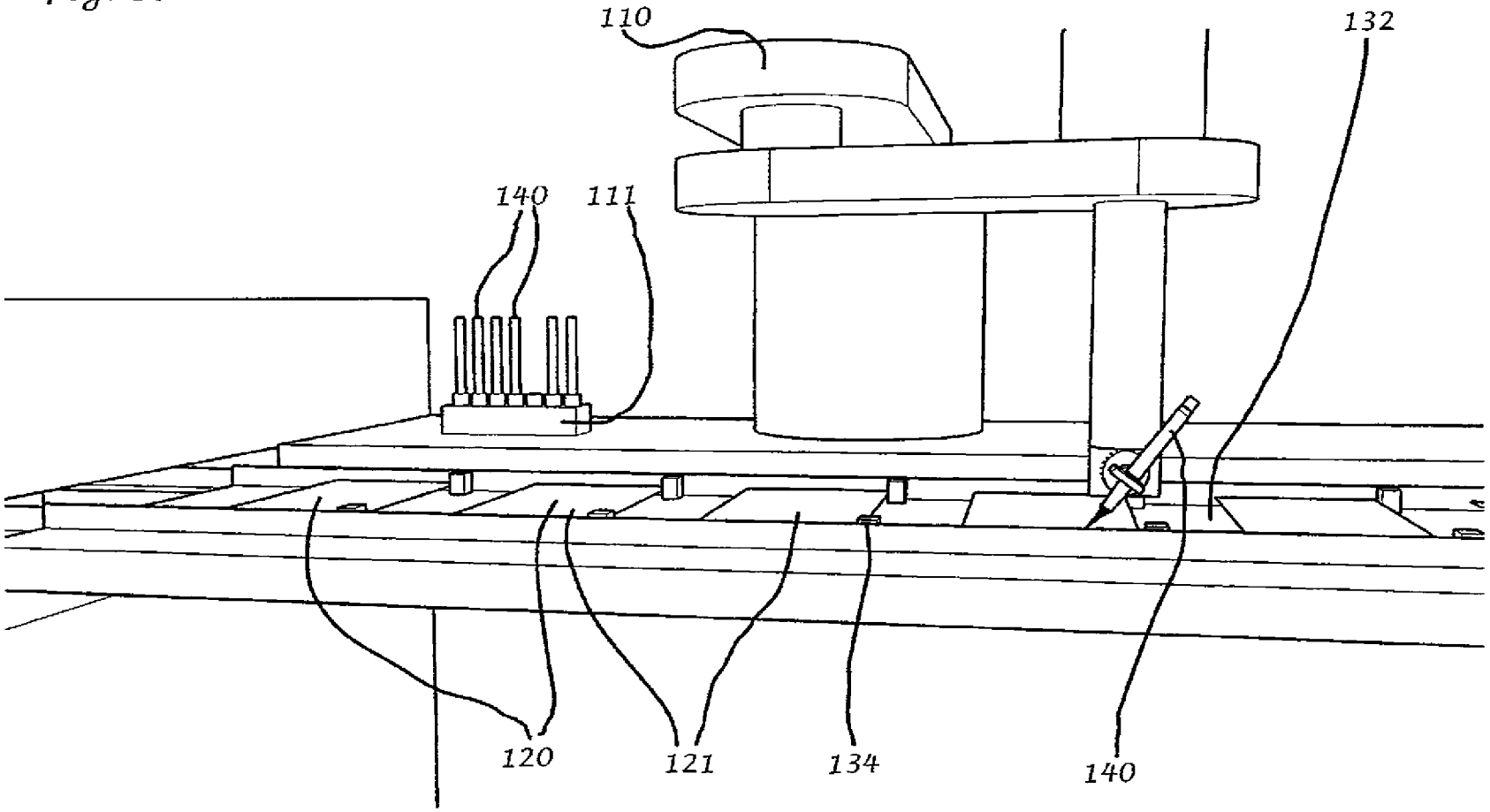
FIG. 37 shows a detail view of a processing machine similar to the processing machine according to FIGS. 33 to 35 with a tool magazine.

The letter paper 130 conveyed on a conveyor belt 132 from the printer 102 is fed after cutting or punching to the writing robot 110, as illustrated in detail in FIG. 4. This writing robot 110 is equipped with a stylus 140, by means of which, for example, a signature or else even an entire handwritten text is applied on the letter paper 130. For this purpose the writing robot 110 is further equipped with an ink reservoir 142, which is in communication with the pen 140 by means of a filling tube 144. Instead of a stylus 140, a pen or a brush may also be used accordingly. Likewise a changing device may be provided, so that the writing robot has available a choice of various styluses 140, brushes 141 (see FIG. 36) or pens. For this purpose a tool magazine 111, for example, can be provided, as is illustrated by way of example in FIG. 37 for use in relation to envelopes 121, which are inscribed and then output as envelopes 120 ready for sending.

The letter paper 130, which is conveyed by means of the conveyor belt 132 and which bears against several followers 134 of the conveyor belt 132, is checked for errors, as already explained in the foregoing, by means of the cameras 106 respectively after the printing operation in the printer 102 and after the processing operation by the robots 108, 110.

Figure 5:
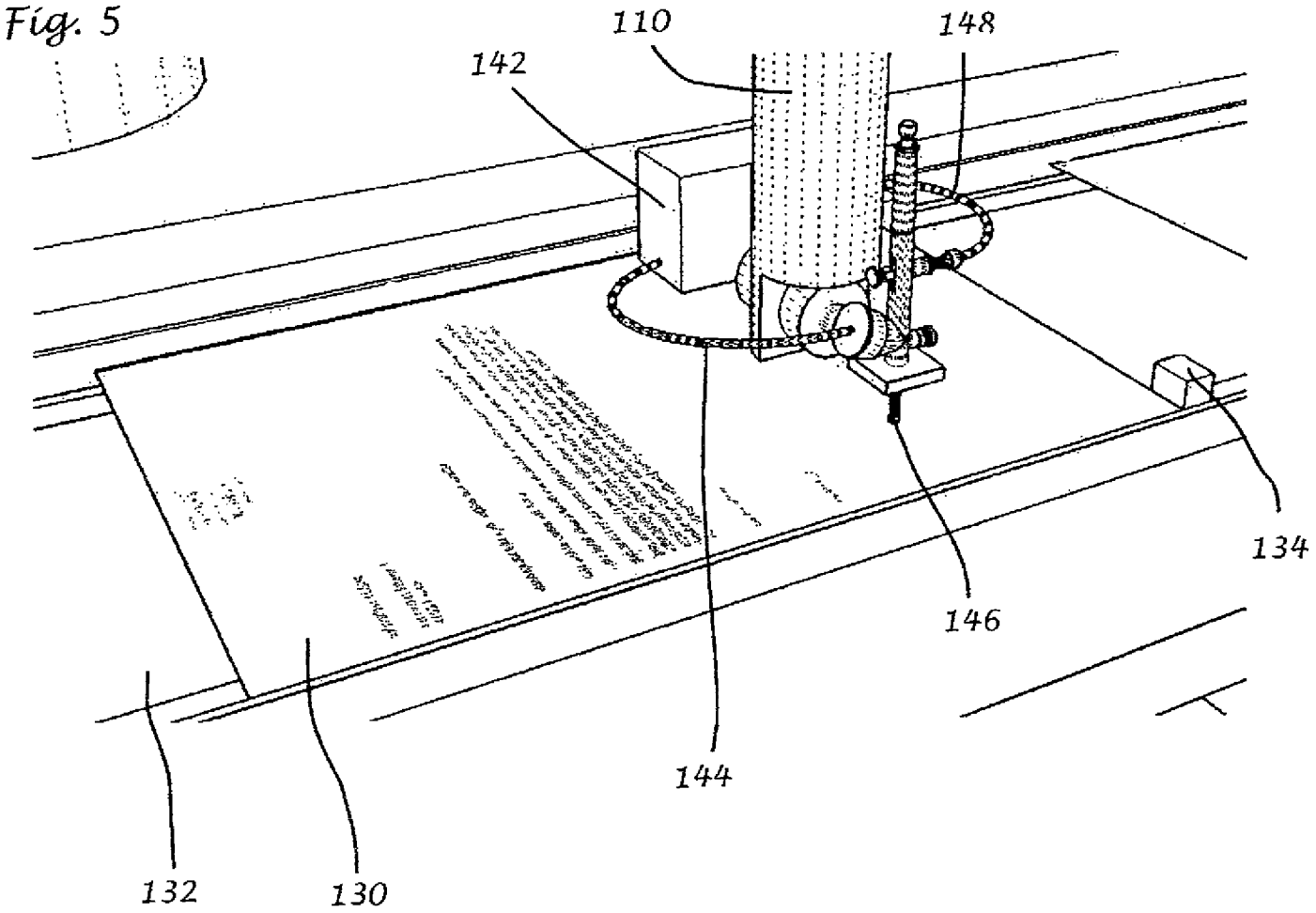
FIG. 5 shows a detail view of a robot with spray head for a processing machine according to FIG. 1.

Instead of the stylus 140, the writing robot 110 according to FIG. 5 has a spray head 146 for processing the letter paper 130. The spray head 146, just as the pen 140, is on the one hand also in communication with the ink reservoir 142 by means of the filling tube 144 and on the other hand has a pneumatic tube 148, by means of which the spraying is controlled. On the one hand, dye or ink, for example, may be sprayed on via the spray head 146. Likewise, for example, an oil or another fluid that changes the transparency of the paper may be sprayed on via the spray head 146, in order in this way to generate or display an individual watermark.

It is immediately obvious that, for use of the spray head 146, on the one hand the cutting robot 108 may also be used and on the other hand several robots 108, 110 may be arranged on the conveyor belt 132, in order to permit not only processing by means of the pen 140 but also the use of the spray head 146. As already explained in the foregoing, the robots 108, 110 may also be equipped with changing heads, so that the respective tools may be exchanged.

As is immediately obvious, the aforesaid tools are respectively substantially one-dimensionally active. Preferably the robots 108, 110 respectively travel at least three-dimensionally, so that on the one hand various movements are possible on the written document and on the other hand at least application on and lifting off or different distances for a spray device or different pressing pressures for a stylus 140 or a brush are possible. As is immediately obvious, still other possibilities of individualization can be achieved by further dimensions in the tool control system, such as, for example, a different orientation of the stylus 140 or of a knife on the cutting head.

As is immediately obvious, the work is performed by the robots 108, 110 preferably when the conveyor belt is stopped, so that a stationary written document preparation operation exists here. It will be understood that certain working steps or working sequences, such as, for example, large area but coarse spraying, can be performed even with the conveyor belt 132 running, without loss of quality. Likewise it is immediately understandable that the working operations explained in the foregoing respectively take place only locally on the respective written document, and therefore that a processing operation respectively takes place substantially at only one location, whereas the rest is processed only at a later time or even not at all.

Figure 6:
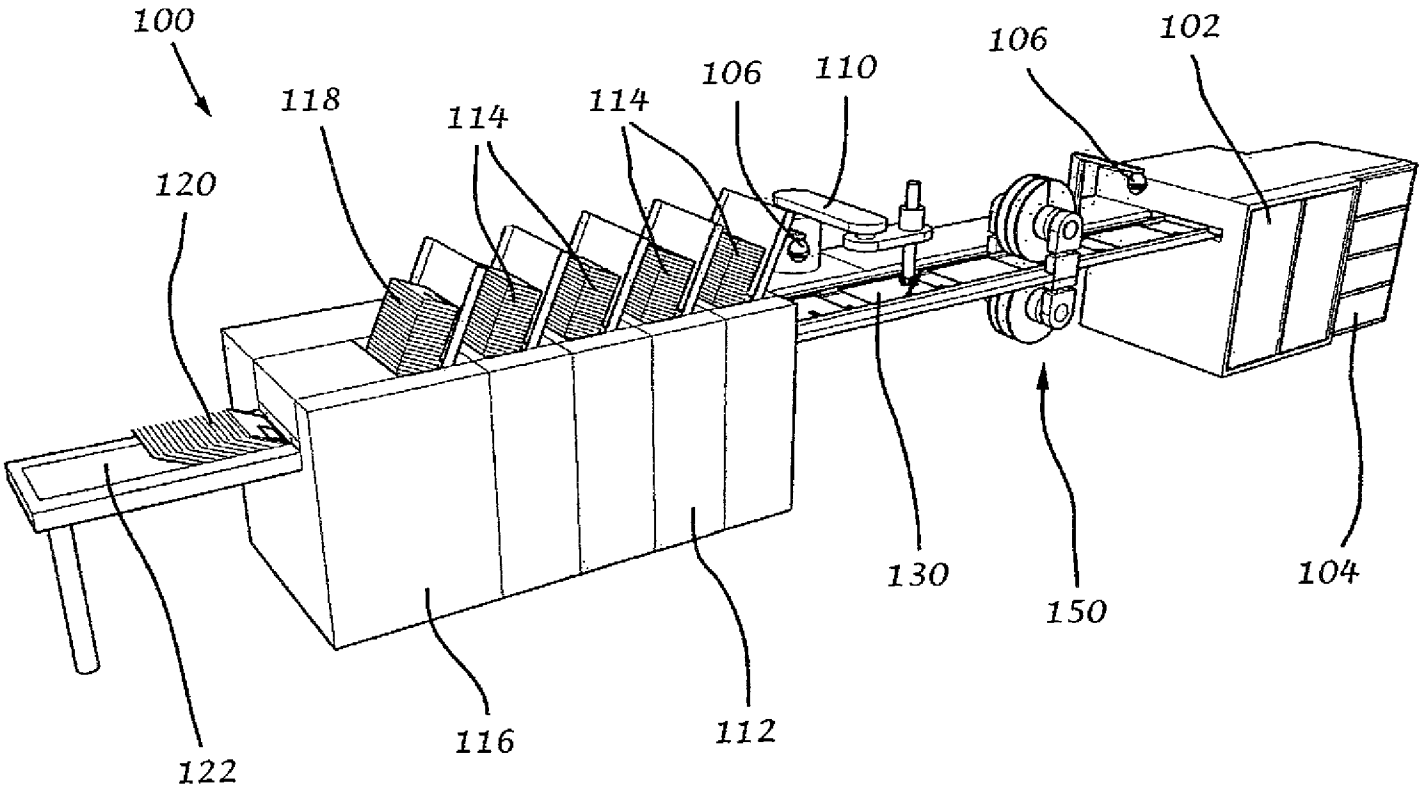
FIG. 6 shows a processing machine with an embossing machine in overall view.
Figure 7:
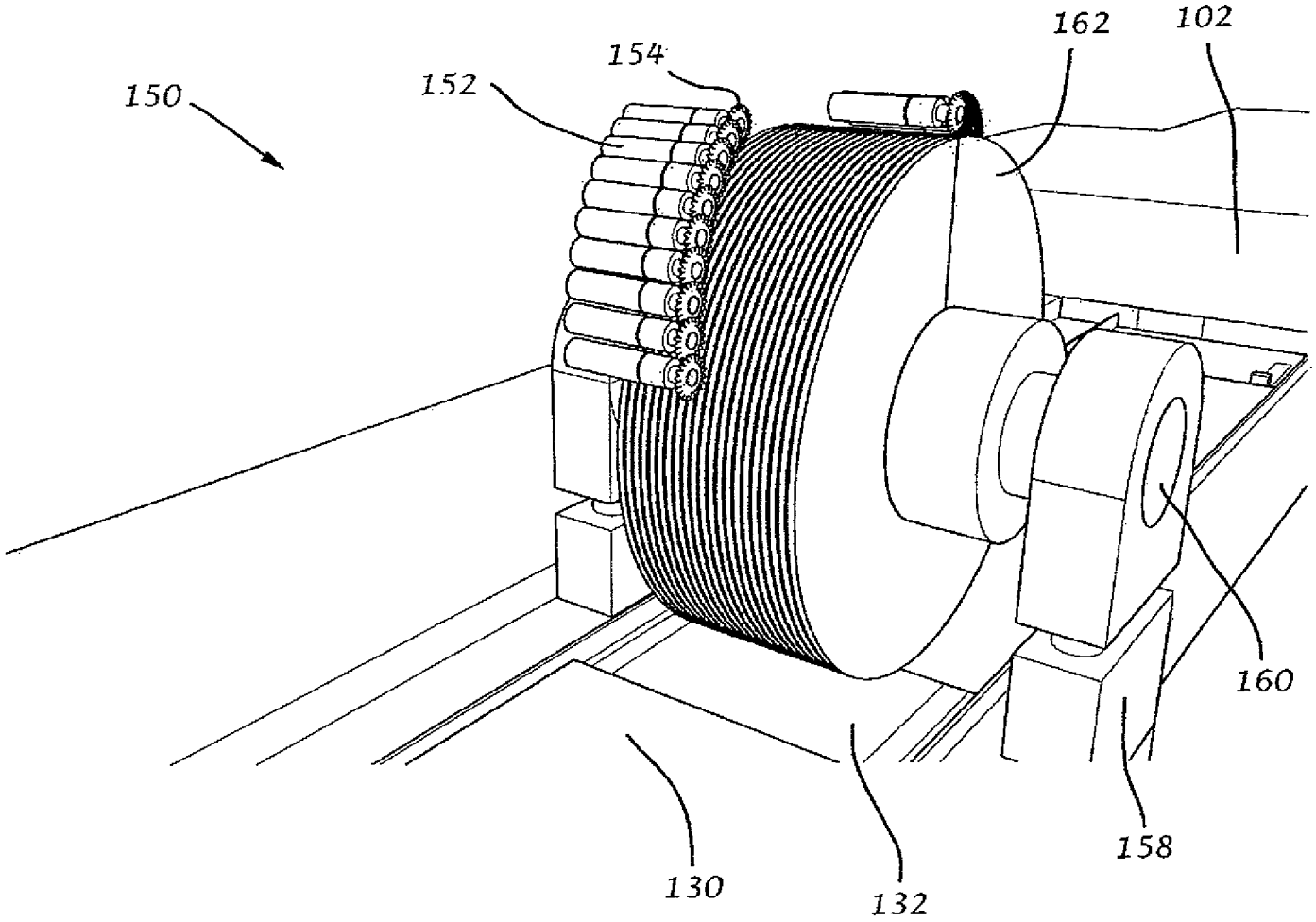
FIG. 7 shows a detail view of the embossing machine according to FIG. 6.
Figure 9:
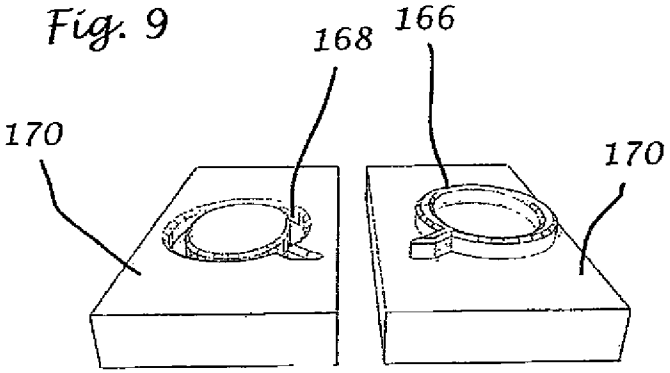
FIG. 9 shows a detail view of a positive and a negative typeface.
Figure 10:
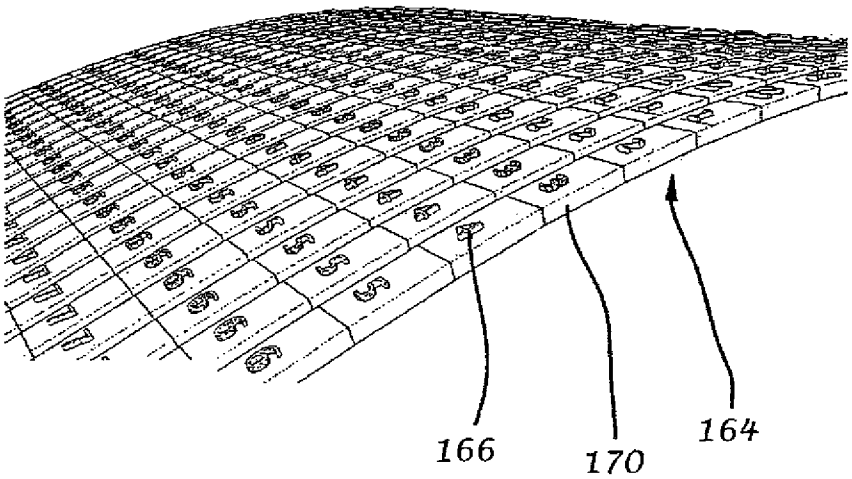
FIG. 10 shows a detail view of an embossing rim of the embossing machine according to FIGS. 7 and 8.
Figure 8:
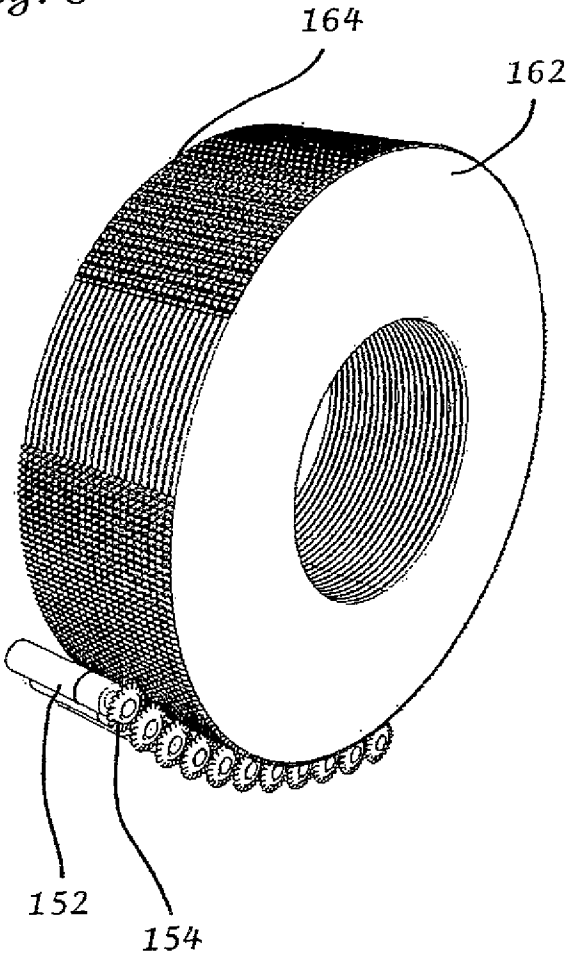
FIG. 8 shows a further detail view of the embossing machine according to FIG. 6.

In a further configuration, the processing machine 100 explained according to FIGS. 1 to 5 may be provided, as is evident from FIG. 6, with an embossing machine 150, by means of which the letter paper 130 is embossed downstream from the printing in the printer 102.

According to FIGS. 7 to 10, the embossing machine 150 consists of at least two embossing wheels 162 disposed opposite one another in pairs. The embossing wheels 162 respectively have several embossing rims 164, which are rotated by means of several toothed gears 154 that engage in a toothing 156 of the embossing rims 164, in order to set desired typefaces 166, 168. The toothed gears 154 in turn are driven by servo motors 152.

Positive or negative typefaces 166, 168 on typeface carriers 170 are respectively disposed on the embossing rims 164, the positive typefaces 166 being structured to act respectively in complementary manner with the negative typefaces 168 and being set in correspondingly complementary manner. The embossing rims 164 fitted with exclusively positive typefaces 166 are respectively disposed on one side, for example the upper side, of the letter paper 130, and the embossing rims 164 with the negative 168 typefaces are respectively disposed on the other side of the letter paper 130. In this connection the desired typefaces 166, 168 are determined by the rotation of the embossing wheels 164, in which case an entire line or several typefaces can be simultaneously embossed with one embossing operation due to the juxtaposition of embossing rims 164, so that more than locally active processing takes place here, although nevertheless it cannot be rated as a printing operation known in itself in such a processing machine 100.

The embossing rims 164 combined as the embossing wheels 162 are mounted rotatably on a bearing block 160, wherein the bearing block 160 guides the embossing rims 164 in the direction of the letter paper 130 by means of an embossing cylinder 158 and presses the typefaces 166, 168 disposed on the respective embossing rim 164 against the typefaces 166, 168 complementary thereto on the underside of the letter paper 130.

Figure 11:
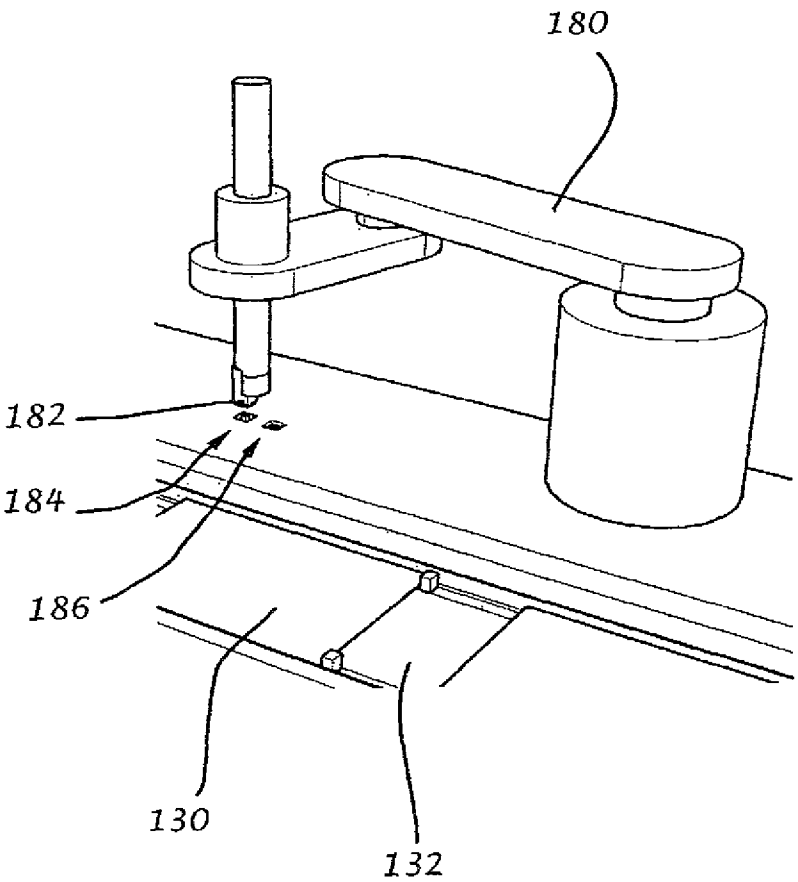
FIG. 11 shows a stamping robot for a processing machine according to FIG. 1.
Figure 12:
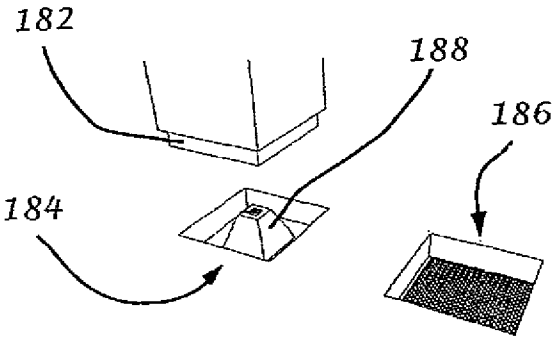
FIG. 12 shows a detail view of a stamp with a dye station and a cleaning station of a stamping robot according to FIG. 11.
Figure 13:
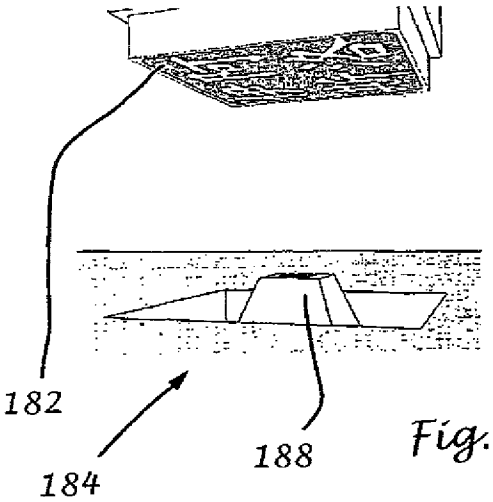
FIG. 13 shows a further detail view of the stamp and of the dye station according to FIG. 12.

As is apparent from FIGS. 11 to 13, a processing machine 100 may also be equipped with a stamping robot 180, which processes the letter paper 130 being fed on the conveyor belt 132 by means of a stamp 182, which ultimately is again to be regarded as substantially local. The stamp 182 being used, which is applied instead of a signature or in addition to a signature, is first sprayed with dye in a dye station 184 by means of a dye head 188.

In this connection, the spraying in the present exemplary embodiment takes place by a technique similar to an ink jet printer, so that the stamp 182 is actually structured as a plane plate, on which appropriate dye application takes place only where a stamped pattern is to be produced. In an alternative embodiment there may be used, instead of a plane plate, a matrix of metal pins, which may be arrayed similarly to a matrix printer head and which then form individual raised points, at which dye can be absorbed—if necessary even via a stamp pad.

After the spraying with dye, the stamp 182 is pressed onto the letter paper 130 by the stamping robot 180. For the production of a new stamped pattern, the stamp 182 is moved into a cleaning station 186, in which the stamp 182 is freed of dye residues and then sprayed anew.

It is immediately obvious that a stamp with three-dimensional or relief-like structure may also be used at this location in conjunction with a stamp pad, if the order to be processed in the processing machine 100 has a sufficiently large number of written documents to be produced. For a smaller order volume, the individually sprayable flat stamp 182 explained in the foregoing or a matrix stamp similar to the printing head of a matrix printer offers a good compromise between the costs and the individualizability of the respective written document.

Figure 14:
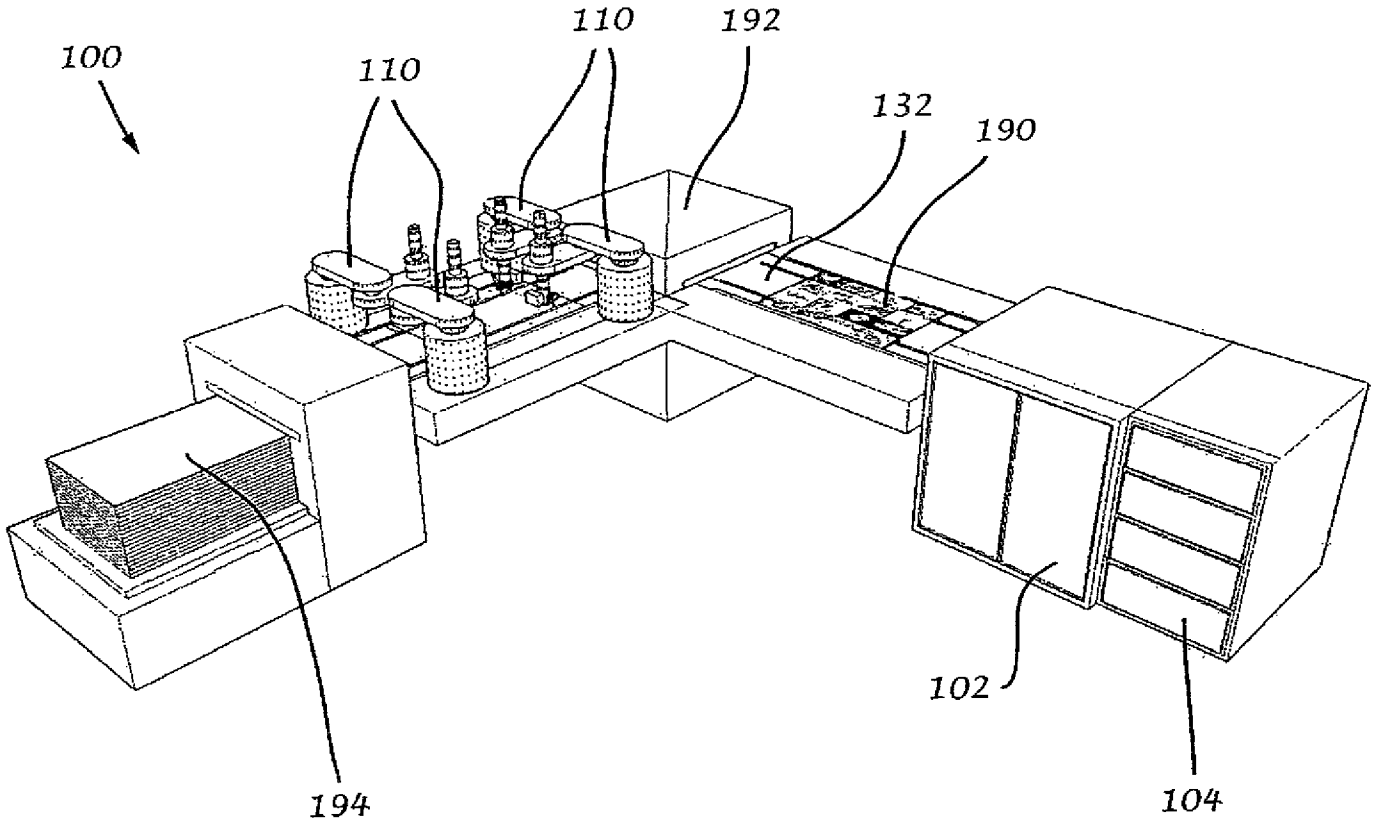
FIG. 14 shows a further processing machine with several writing robots in overall view.
Figure 15:
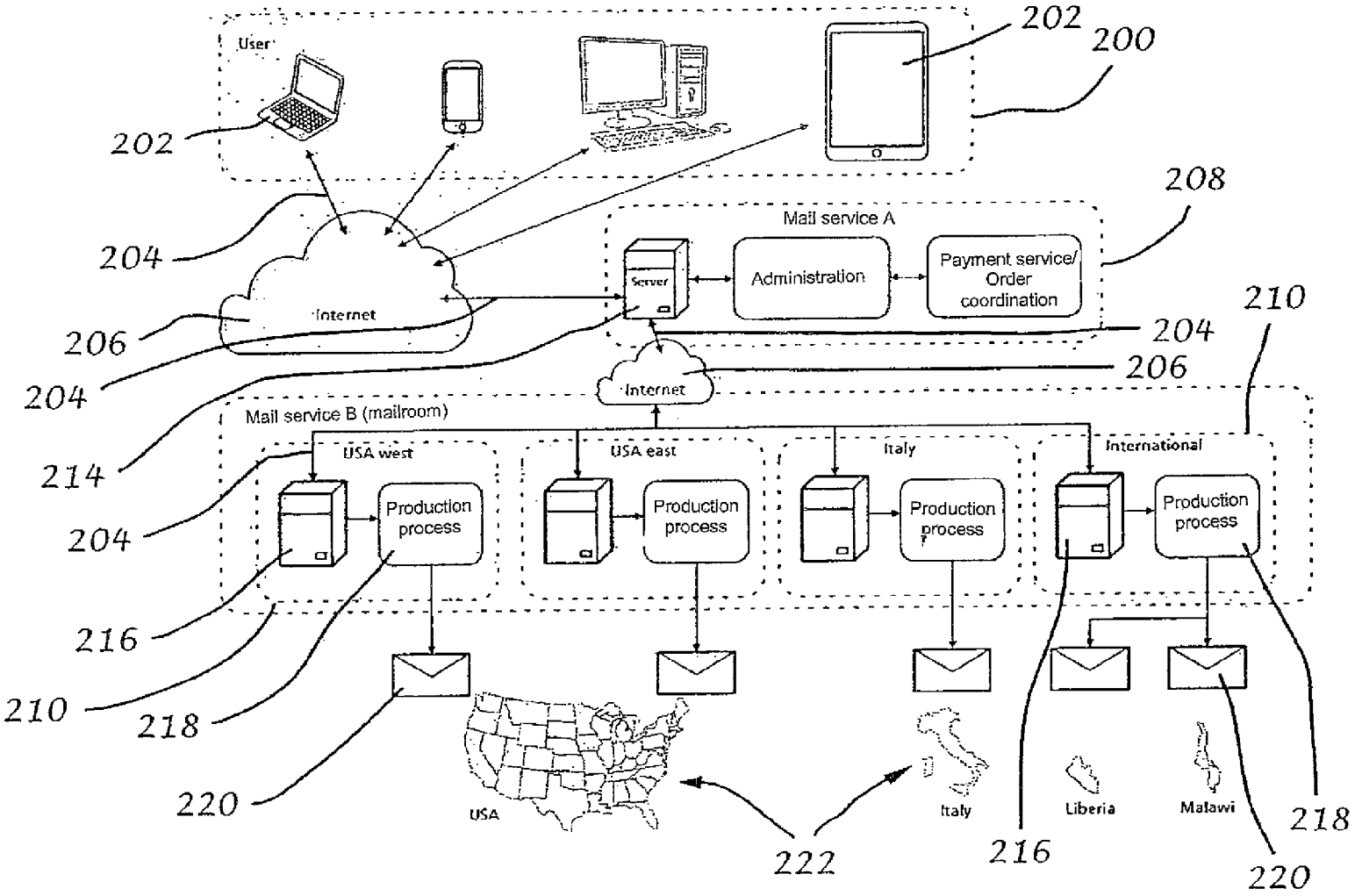
FIG. 15 shows a schematic general overview of an operation of purchase-ordering, production and sending of a written document.

The processing machine 100 may also be operated in multi-stream mode, by equipping the robots 108, 110, for example, with identical tools and respectively processing only each second flat article or each second sheet, as is illustrated, for example, in the processing machine illustrated in FIG. 35 et seq. for envelope 121, for example. Above and beyond this a multi-stream arrangement of the writing robots 110 is also possible in the processing machine 100. As is apparent from FIG. 14, sheet cards 190 created in the printer 102, for example, can be processed simultaneously with four writing robots 110. The sheet card 190, on which several postcards arranged side-by-side can be printed, is therefore, after being fed through a turning station 192, smoothly further processed by means of the writing robots 110. By means of the use of several writing robots 110, a good capacity usage of the printer 102 is therefore ensured, since it does not have to wait to a high degree for the further processing of the sheet cards 190 and can print sheet cards 190 with its full capacity.

After the inscription by means of the writing robots 110, the finish-processed sheet cards 190 can be collected on a tray 194 on the processing machine 100 and fed together to a further processing system, for example a cutting station.

Figure 38:
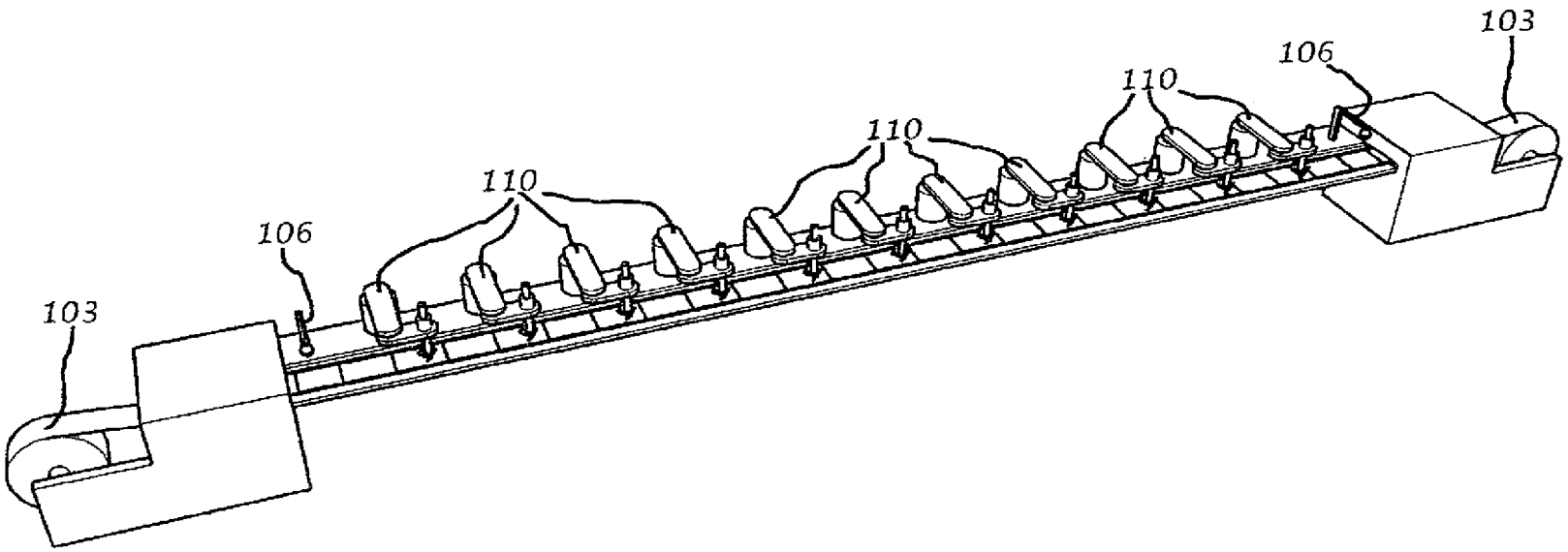
FIG. 38 shows a further processing machine in an overall view.
Figure 39:
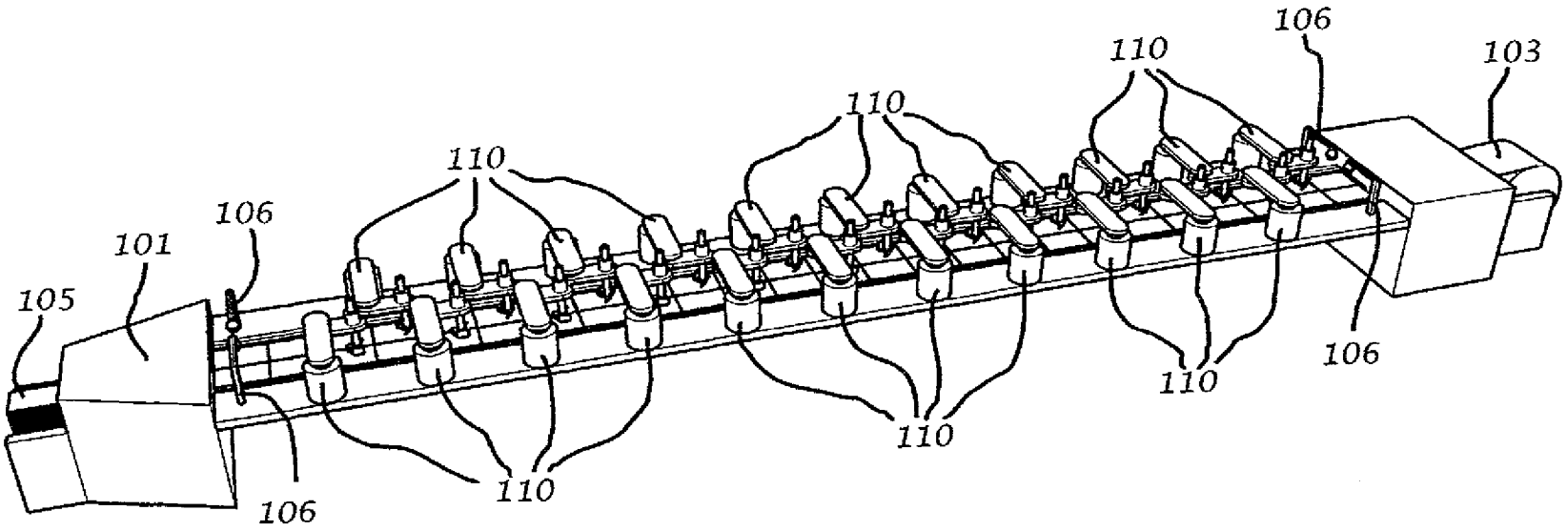
FIG. 39 shows a further processing machine in an overall view.

Likewise a multi-stream application corresponding to the arrangement according to FIG. 38 or 39 can naturally be provided. In this connection the processing machines 100 according to FIGS. 38 and 39 dispense with insertion, although this is done if necessary, depending on specific implementation in a separate installation, wherein appropriate integrity can be assured if necessary by a scan of the applied addresses or by a separate control code. Both processing machines 100 operate with an endless paper roll 103, the endless paper of which is passed through the processing machine 100. Whereas the processing machine 100 according to FIG. 38, after the endless paper has passed through the processing machine 100, rolls it up again to an endless paper roll 103, which can then be unrolled again if necessary at another location and cut up in the desired way, the processing machine 100 according to FIG. 39 has a separating device 101, which separates the endless paper after it has been passed to a plurality of writing robots 110 and deposits it on a paper stack 105. If desired, the paper of the paper stack can then be further processed by first performing a scan operation on an address or a control code or an insertion into window envelopes.

The processing machine 100 according to FIG. 38 operates only in single-stream mode in passage direction, but, depending on specific process control, there can be provided a clocked passage, so that each individual writing robot 110 completely processes one stream, or a continuous passage, when the processing is intended to be only temporary, for example only for a signature, or when the writing robots work successively on respectively one part of the written document. In contrast, the processing machine 100 according to FIG. 39 operates in dual-stream mode in passage direction, so that, in comparison to the processing machine 100 according to FIG. 38, a double-wide paper web is necessary if identical written document sizes are to be created and the two streams must be split apart in passage direction in a subsequent process step, as takes place in the present exemplary embodiment in the separating device 101, although in an alternative thereto can also take place at a separate location.

It will be understood that, in the arrangements according to FIGS. 38 and 39, other robots or corresponding processing devices, such as robots with brushes 141, cutting robots 108 as well as robots with spray heads 146, stamps or embossing devices, etc. may also be provided instead of the writing robots 110 or may be combined therewith.

The process sequence for creating, producing and sending a written document 220 ready for sending is provided with, as is evident from FIGS. 15 to 21, at least one customer interface 200, with a central mail center 208, which is the mail service A, and with a decentralized mail center 210, which is the mail service B. At the customer interface 200, the customer is able, via an arbitrary input unit 202, to send data to a central computer 214 of the central mail center 208 by means of a network connection 204 and via a network 206. The central computer 214 takes over on the one hand the administration of customer and order data as well as all payment operations and on the other hand the order coordination.

The central computer 214 sends the order data via a further network connection 204 to respective production computers 216 of a single or of several decentralized mail centers 210. The activation of the decentralized mail center 210 takes place via the ascertainment of the respective letter recipient. Thus the individual decentralized mail centers 210 are located in various sending regions 222, in order to ensure a shortest possible sending time between a processing machine 218 of the decentralized mail center 210 and the physical recipient of the written document 220 ready for sending, as well as a most cost-effective sending operation as possible. Thus, for example, decentralized mail centers 210 are located on the east and west coasts of the United States of America, in order to serve the respective letter recipients there regionally. Conversely, individual decentralized mail centers 210 can also serve several smaller sending regions 222. Thus it may be provided, for example, that one common decentralized mail center 210 is responsible for the sending of letters in two neighboring individual countries, such as, for example, Luxembourg and Belgium or Lichtenstein and Switzerland, or else two states of a continent with low order volume, such as, for example, Liberia and Malawi.

As is immediately obvious, the electronic order processing operation in this exemplary embodiment takes place on the one hand locally at an order administration system 212 and on the other hand in decentralized manner in the individual production computers 216.

Figure 16:
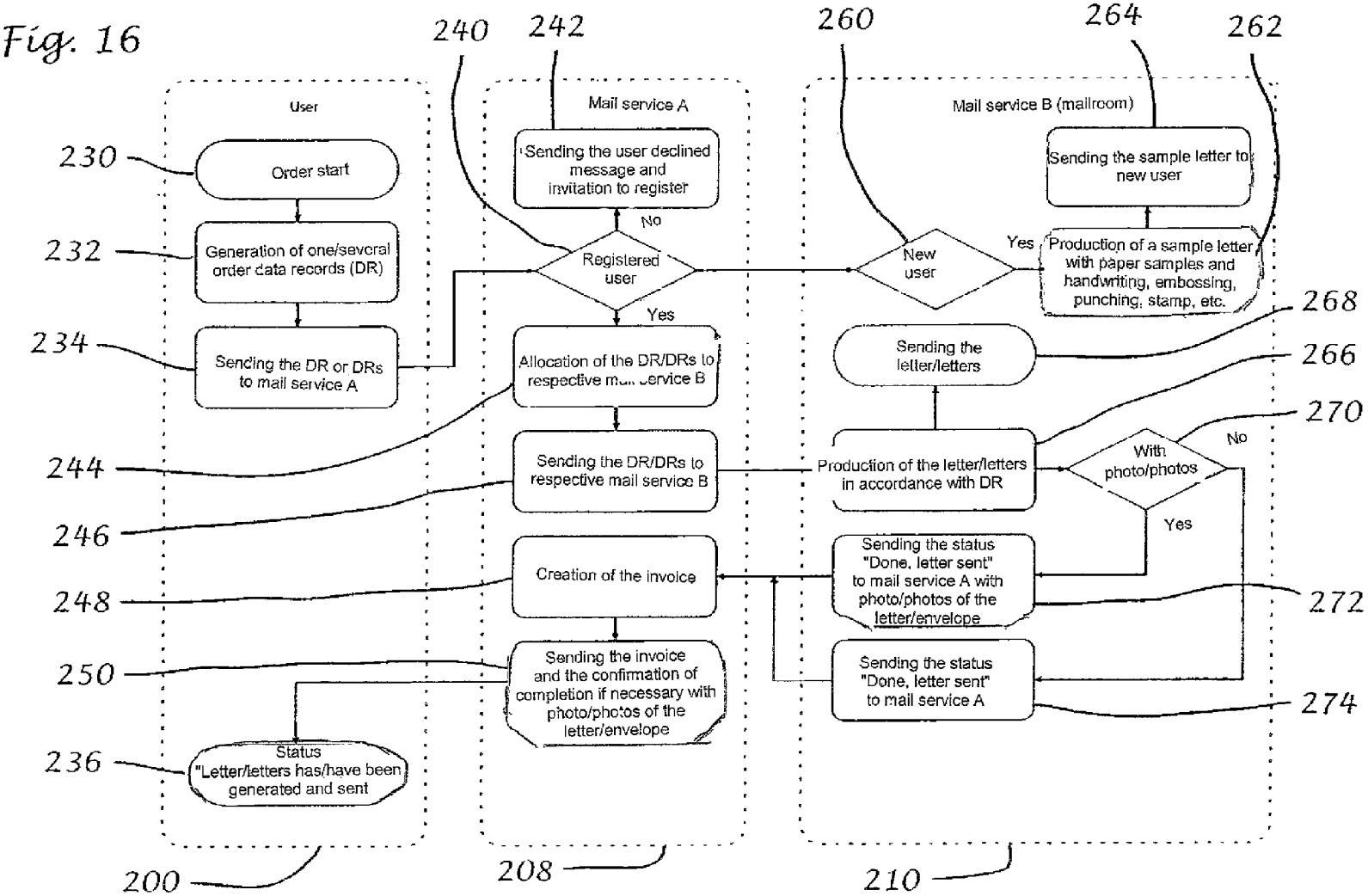
FIG. 16 shows a schematic flow diagram of an operation of purchase-ordering, production and sending of a written document.

After the start 230 of the order on the part of the customer interface 200, as is evident from the diagram according to FIG. 16, a data record generation operation 232 as well as a subsequent data record sending operation 234 to the central mail center takes place.

In the central mail center 208, a user query 240 is first started to check whether the customer has already been registered. If this is not the case, registration 242 takes place with a corresponding invitation or prompt to the customer. At the same time, a user query 260 takes place in the decentralized mail center 210, after which a sample letter production operation 262 is started and a sample letter with paper samples and samples of handwriting, embossing and punching as well as of the stamp and the like are sent to the new customer via a sample letter sending operation 264.

In the case of an already registered customer, a data record allocation operation 244 takes place in the central mail center 208 after the user query 240, whereby the decentralized mail center 210 matching the present order is selected. Thereupon the sending of the present order data record to the decentralized mail center 210 takes place via a data record sending operation 246.

In the decentralized mail center 210, a letter creation operation 266 takes place first, followed by a letter sending operation 268. As already explained hereinabove, because of the suitable choice of the decentralized mail center 210, the letter sending operation 268 on the one hand takes place inexpensively for a customer located abroad, since only the domestic postage fees have to be paid, and on the other hand relatively accurate scheduling of the letter to be sent is possible, since by means of the regionally located decentralized mail centers 210 the necessary sending times are known with great accuracy. In this respect a customer located abroad is able to determine the date of receipt of greeting cards for festive occasions, for example, very simply. Thus it is also possible, for sending of vacation greeting cards, to generate these already in advance from the home office and to choose the date of sending of the written document so as to coincide with the vacation.

After the letter creation operation 266 in the decentralized mail center 210, a picture query 270 further takes place to establish whether the client has requested a photo of the finished written document 220 ready for sending. Depending on positive or negative query in the picture query 270, a status report 272, 274 is issued, by means of which a response to the central mail center 208 is issued. After the response has been issued, an invoice creation operation 248 as well as an invoice sending operation 250 is initiated in the central mail center 208, while a status report 236 about the individual steps is displayed at the customer interface 200. Here the corresponding proof photo, which can be recorded, for example, via the cameras 106, may also be queried, but it will be understood that here an entire film of the writing operation may also be made available if necessary.

Figure 17:
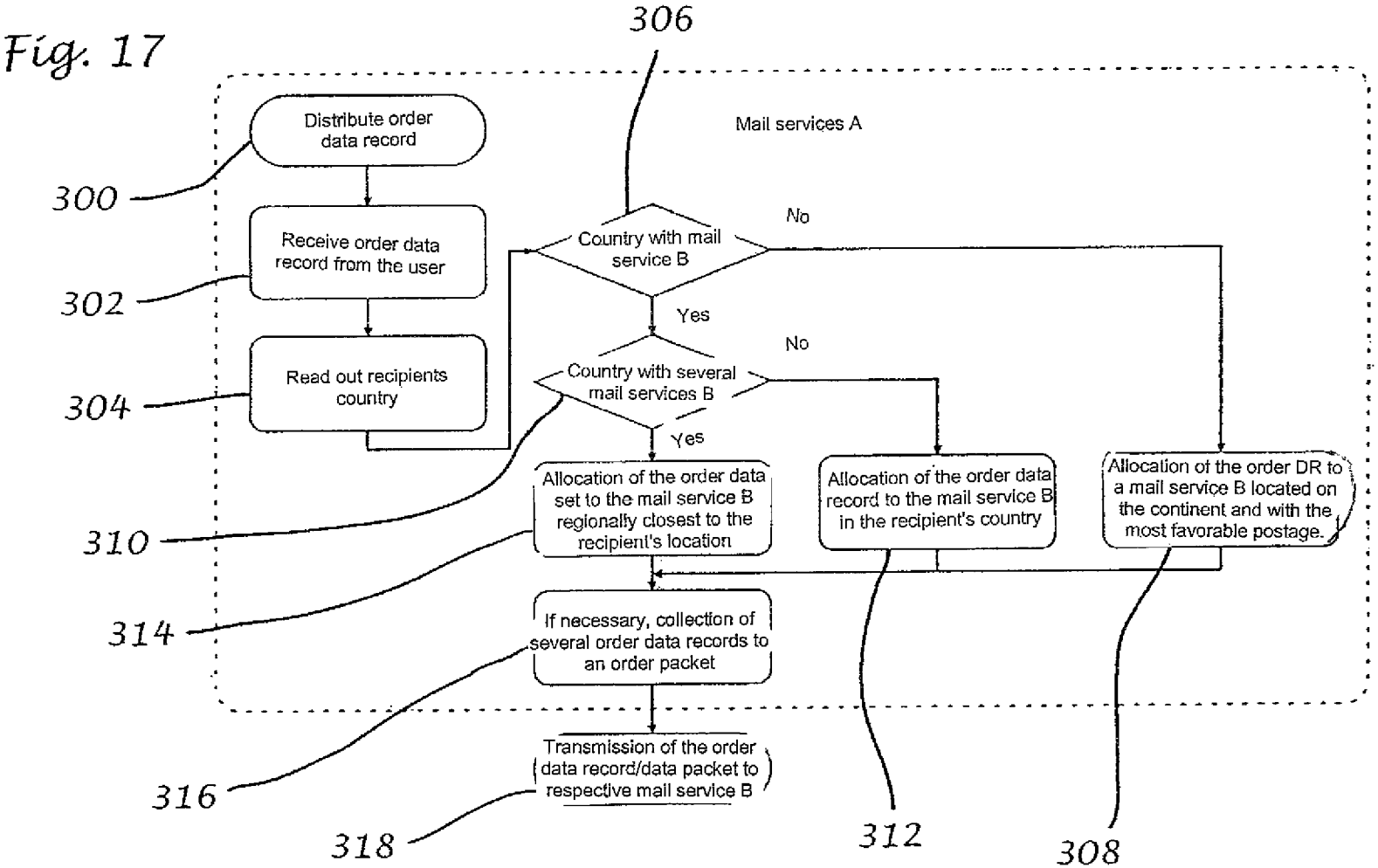
FIG. 17 shows a schematic process sequence in a mail center according to FIGS. 15 and 16.

During the data record allocation operation 244 and the data record sending operation 246 in the central mail center 208, several process steps take place, as are illustrated by way of example in FIG. 17. For this purpose, after a data record distribution operation 300, firstly a data record receiving operation 302 takes place, in which the order data records are sent by the customer to the central mail center 208.

A recipient identification operation 304 takes place in a first step and is followed by a first recipient query 306. The first recipient query 306 examines whether a decentralized mail center 210 is located in the recipient's country. If this is not the case, a recipient allocating operation 308 takes place, with allocation of the order data to a decentralized mail center 210 located on the continent of the recipient's country.

If a positive recipient query 306 takes place, a further recipient query 310 follows, in which the existence of several decentralized mail centers 210 in the recipient's country is examined. If the examination is negative, then a recipient allocation operation 312 takes place, in which the order data record is allocated to the respective decentralized mail center 210 in the recipient's country.

In the case of a positive recipient query 310, a recipient allocation operation 314 takes place, in which the decentralized mail center 210 located regionally closest to the recipient's location is identified. Before a data record communication operation 318 to the decentralized mail center 210 takes place, several existing order data records are combined to an order packet in a data consolidation operation 316, in order to take advantage of synergy effects and to increase the efficiency of the sending and creation process.

Figure 18:
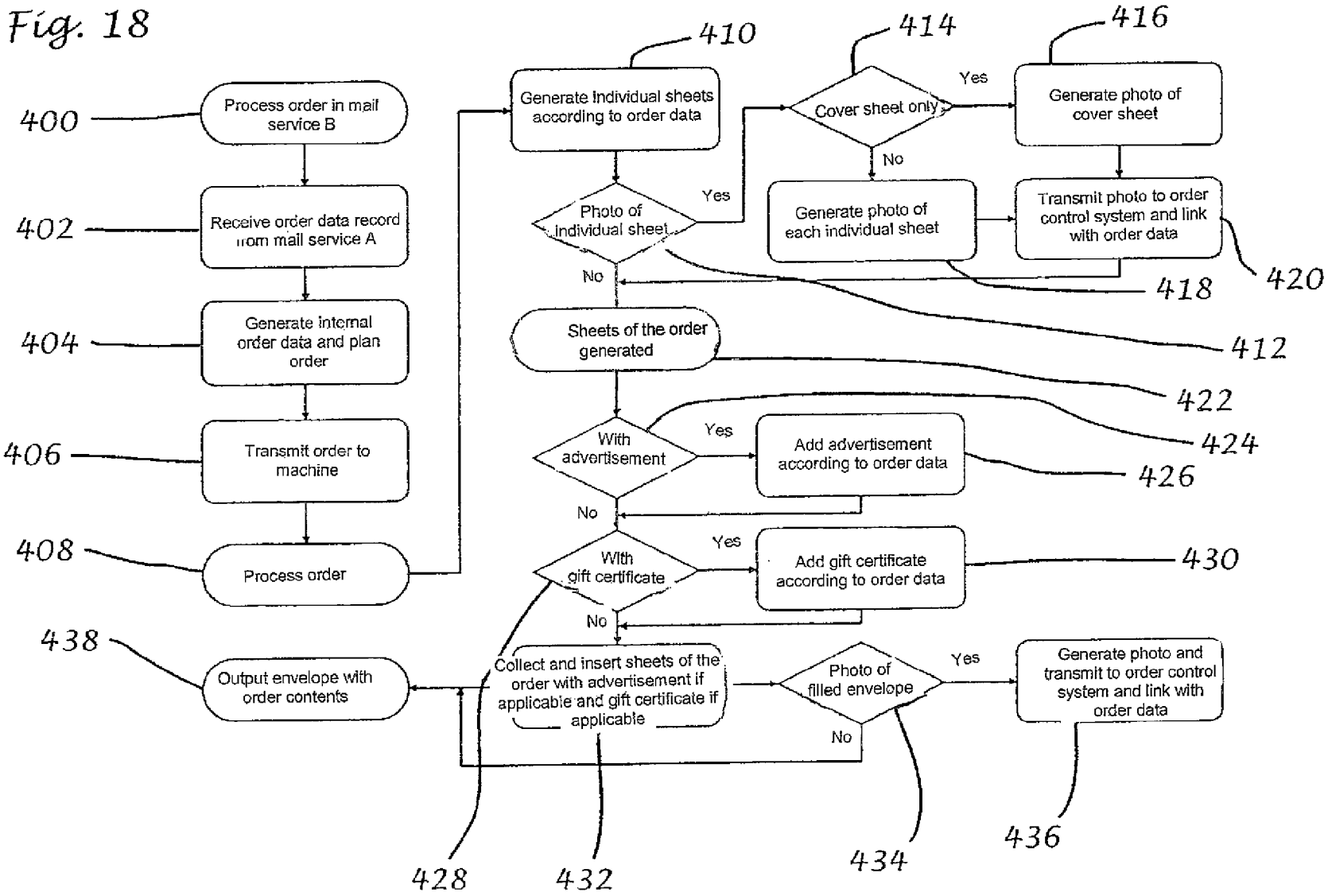
FIG. 18 shows a schematic process sequence in a further mail center according to FIGS. 15 and 16.

As is evident from FIG. 18, a data record reception operation 402 first takes place during an order processing operation 400 in the decentralized mail center 210, followed by an order planning operation 404, in which the internal order data are generated and the order is integrated into the entire production process. Thereupon an order transmission operation 406 to the processing machine takes place and an order relay operation 408 with the order start coupled thereto is executed.

If an individual sheet production operation 410 in the processing machine has been completed, a picture query 412 takes place, which in the case of a positive query leads to generation of a photo of the order. Before generation of an order photo, a cover sheet query 414 is executed, which in the positive case leads to a picture generation operation 416, in which a photo of the cover sheet of the order is established and saved. If the cover sheet query 414 is assessed as negative, a picture generation operation 418 takes place for each individual sheet of the order.

Following the picture queries and the picture generation operations 416, 418, a picture transmission operation 420 takes place, in which the produced pictures are linked with the order data. This is followed by the further process sequence with an order relay operation 422. This in turn is followed by two further queries, one an advertising query 424 and the other a gift certificate query 428. In the case of a respective positive query, an advertisement production operation 426 and/or a gift certificate production operation 430 takes place.

If the order or the sheets of the order have been successfully completed, an insertion operation 432 with an envelope output operation 438 takes place. Between the insertion operation 432 and the envelope output operation 438 there is disposed a further picture query 434, by means of which, in the case of a positive query, a photo of the filled envelope is generated and a picture transmission operation 436 is initiated, whereby the generated photo is transmitted to the order controller and this is linked with the order data.

Figure 19:
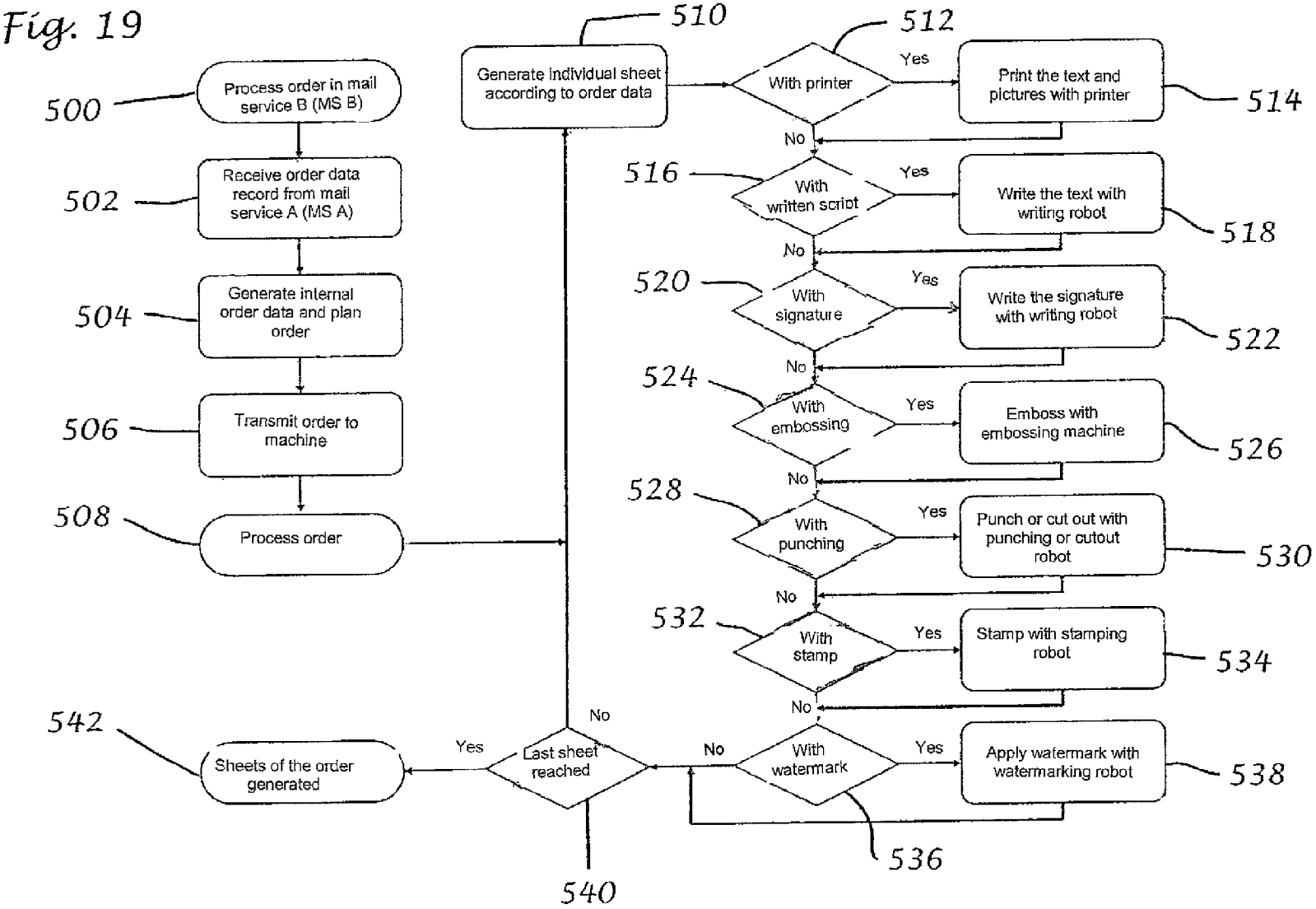
FIG. 19 shows a further detailed process sequence for single-sheet generation in the mail center according to FIG. 18.

An individual sheet generation operation 510 takes place in the decentralized mail center 210 after an order processing operation 500, a data record reception operation 502, an order planning operation 504, an order transfer operation 506 as well as an order relay operation 508—analogous to the process described according to FIG. 18—have been executed, firstly via a printing query 512, as is evident from the diagram according to FIG. 19. The printing query 512 first checks whether a printing operation 514, in which text and figures are produced by means of the printer 102, is to take place.

This is followed by a writing script query 516, by means of which, if the query is positive, a script creation operation 518 takes place. The script creation operation 518 serves cumulatively or alternatively to the printing by means of the printer 102 for the generation of a handwritten text by the writing robot 110. If a signature query 520 takes place positively, the writing robot 110 is also used for signature generation 522. As is immediately obvious, subsequent processing steps, such as, for example, an embossing query 524, a punching query 528 or a stamping query 532, may also take place in alternative sequences within the overall sequence of the existing queries of the individual sheet production operation 510. The sequence ultimately selected depends on the arrangement of the respective cutting robots 108 or writing robots 110 or of the embossing machine 150 and other machines or processing stations in the processing machine 100, in which case attention must be paid here if necessary to ensure that certain processing steps are not damaged by subsequent working steps, for example that a seal does not subsequently break.

If a positive embossing query 524 takes place, an embossing operation 526 is preferably performed by means of the embossing machine 150. In analogy to this, a punching operation 530 or a stamping operation 534 is also performed according to the respective queries. As already explained in the foregoing, the punching operation 530 may also take place by means of the cutting robot 108, if this is equipped with a punching tool. In this respect, it will be understood that a cutting query may also be provided here with a cutting operation initiated hereby.

After the stamping query has taken place, which in the positive case initiates the stamping operation 534 by the stamping robot 180, a watermark query 536 takes place. A watermark generation 538 following this watermark query 536 may if necessary use the spray head 146 described hereinabove for generating a watermark.

The individual steps of the production process arranged within the single-sheet generation operation 510 are repeated until the subsequent sheet query 540, in which the attainment of the last order sheet is queried, is positive. In this case a status transmission 542 takes place, followed by the process illustrated in FIG. 18, with the picture query 412.

Figure 20:
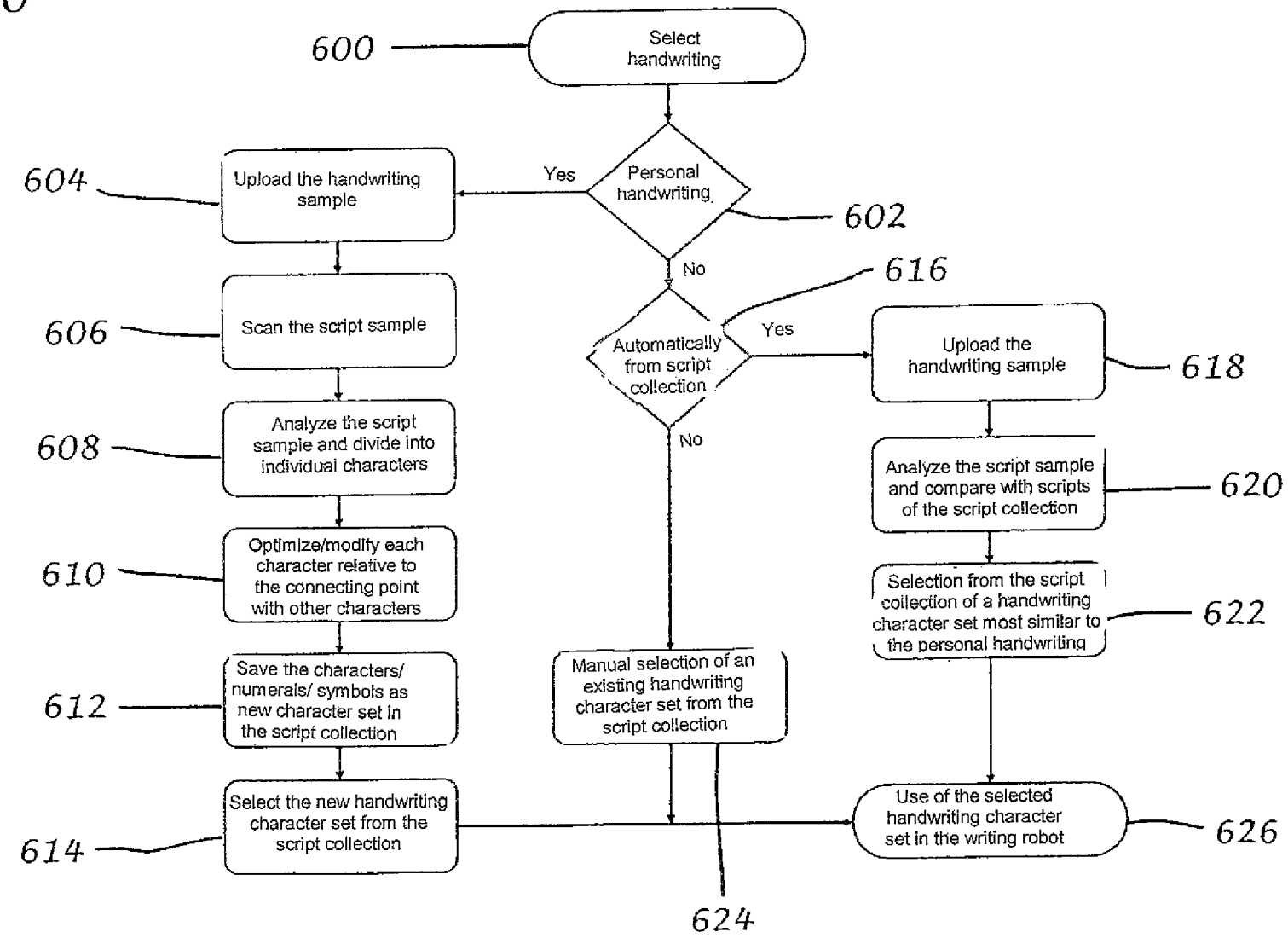
FIG. 20 shows a detailed process sequence for selection of handwriting for the process according to FIG. 19.
Figure 21:
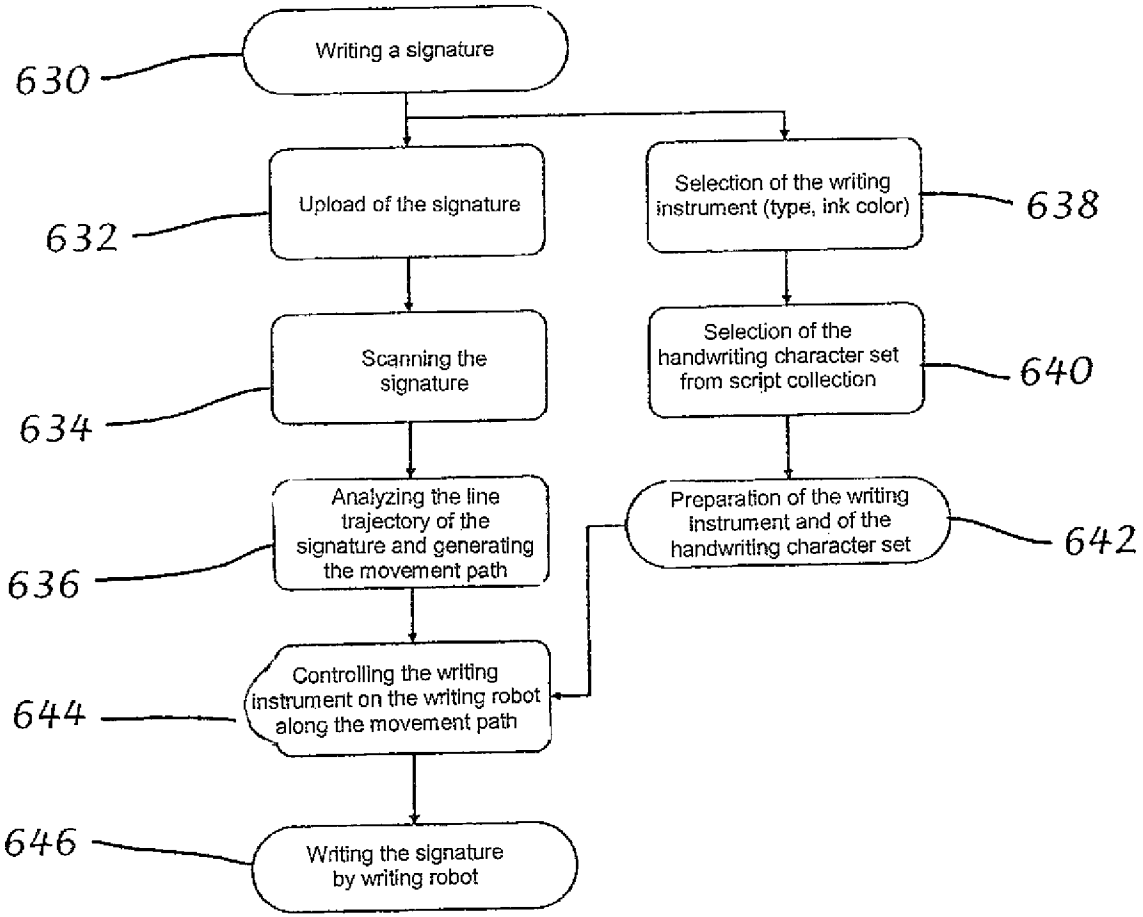
FIG. 21 shows a detailed schematic process sequence for the creation of a signature according to FIG. 19.
Figure 22:
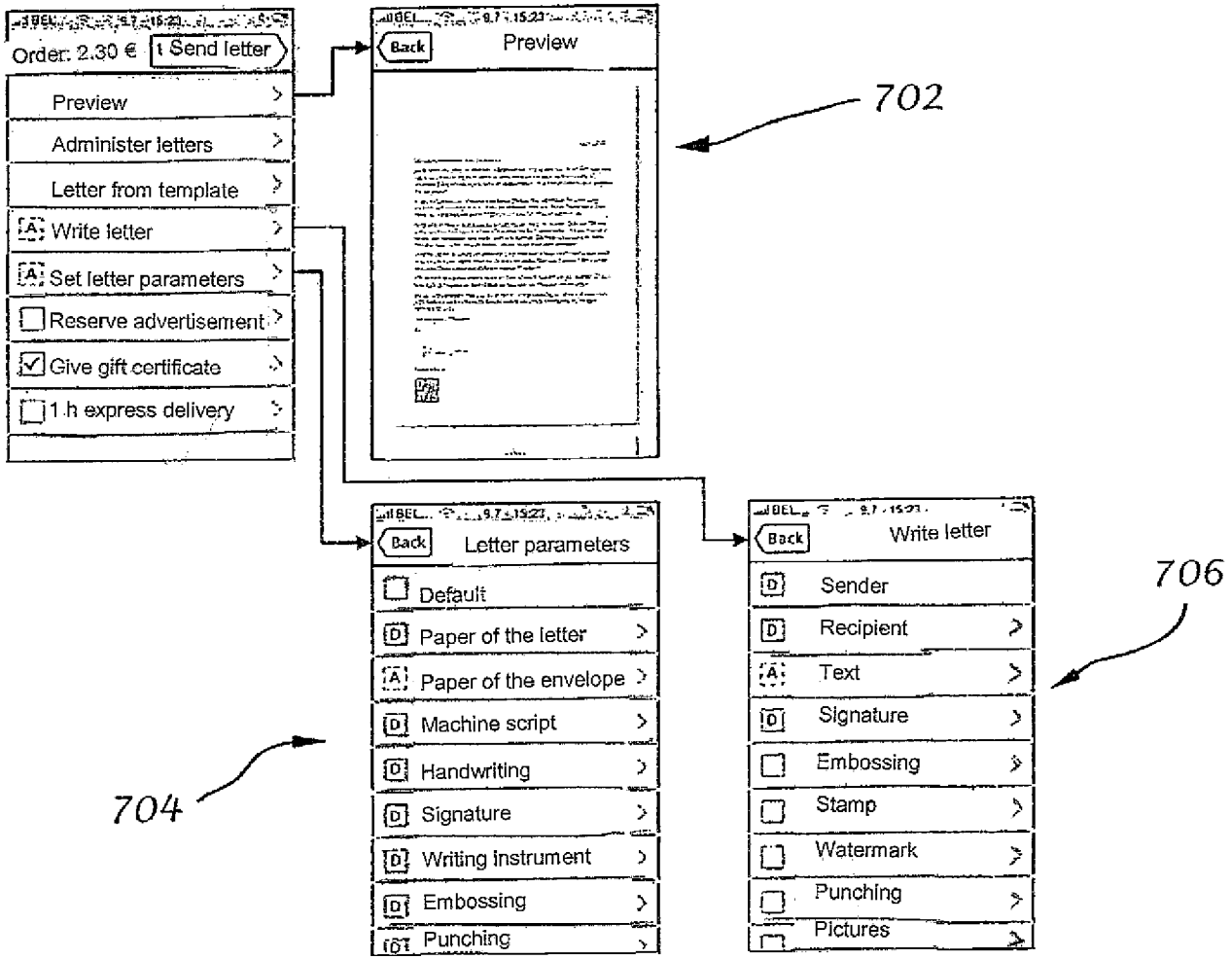
FIG. 22 shows a schematic overview of an interface for the acquisition of purchase-order data.
Figure 23:
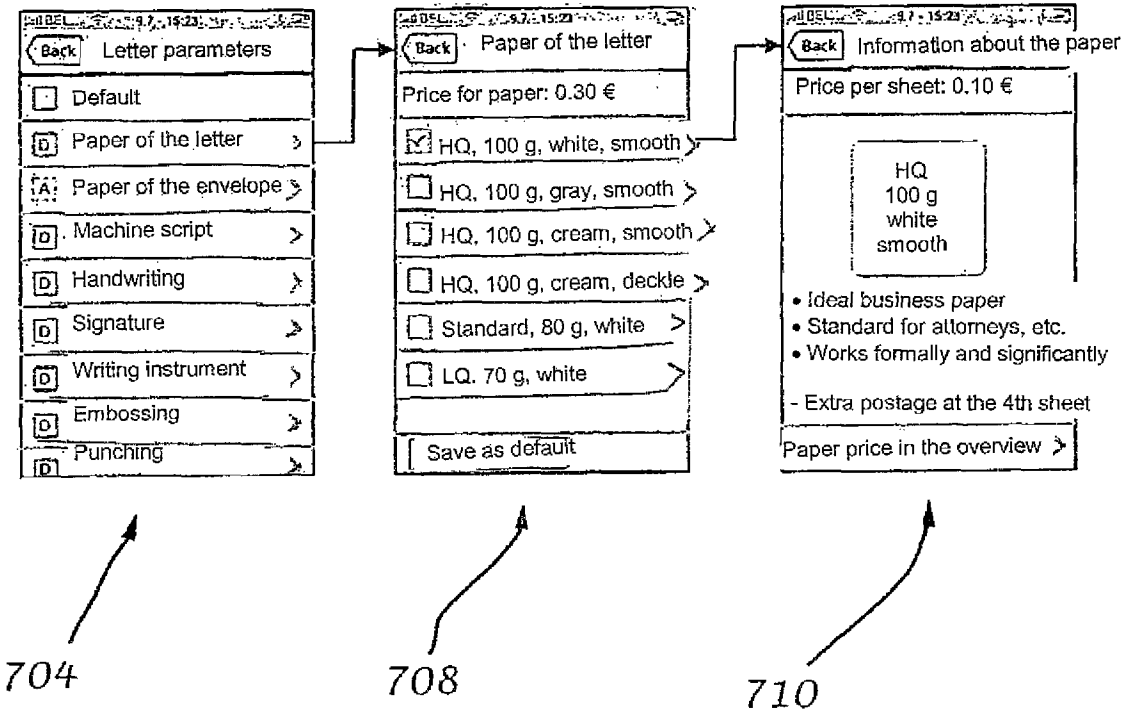
FIGS. 23 to 26 show an interface overview for the interface point "Set mail parameters" according to FIG. 22.
Figure 24:
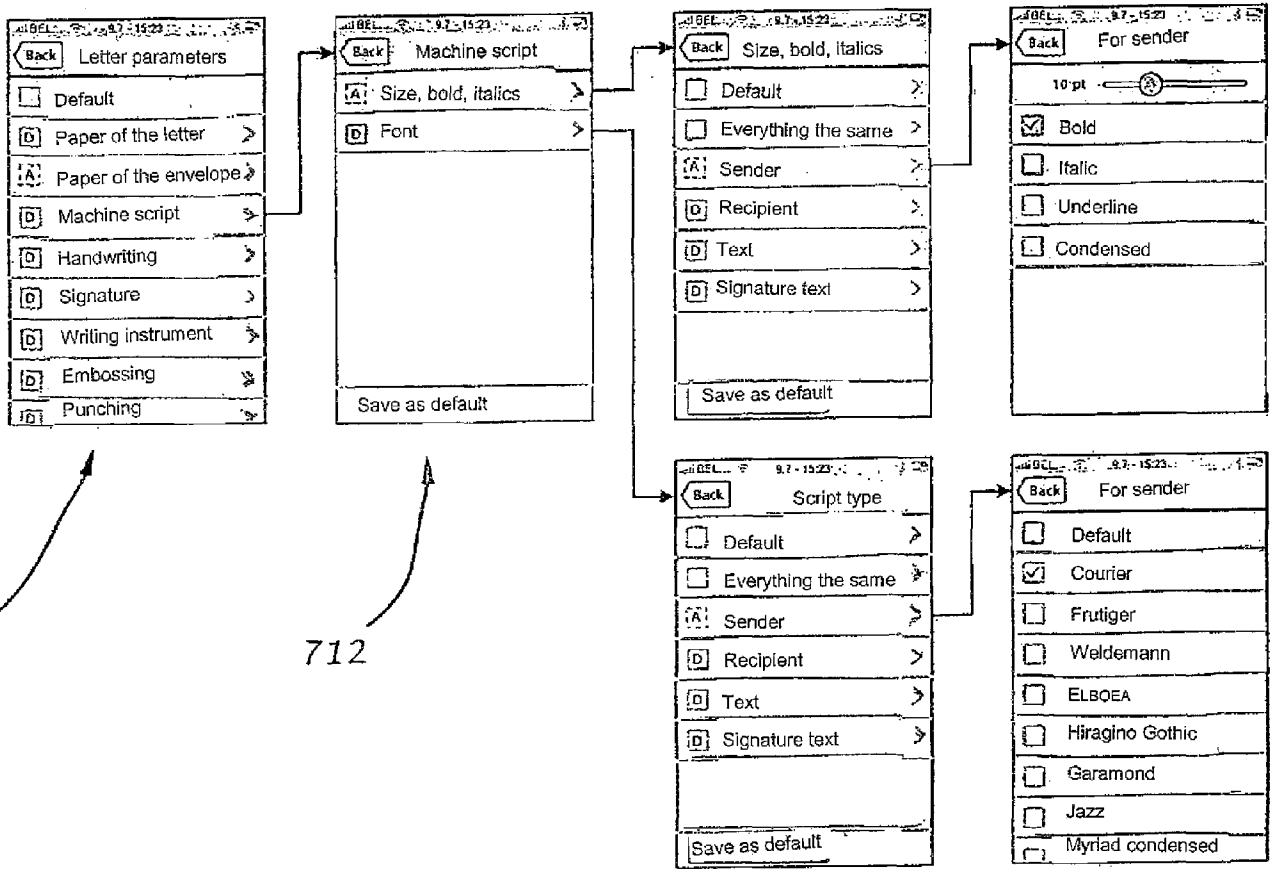
Figure 25:
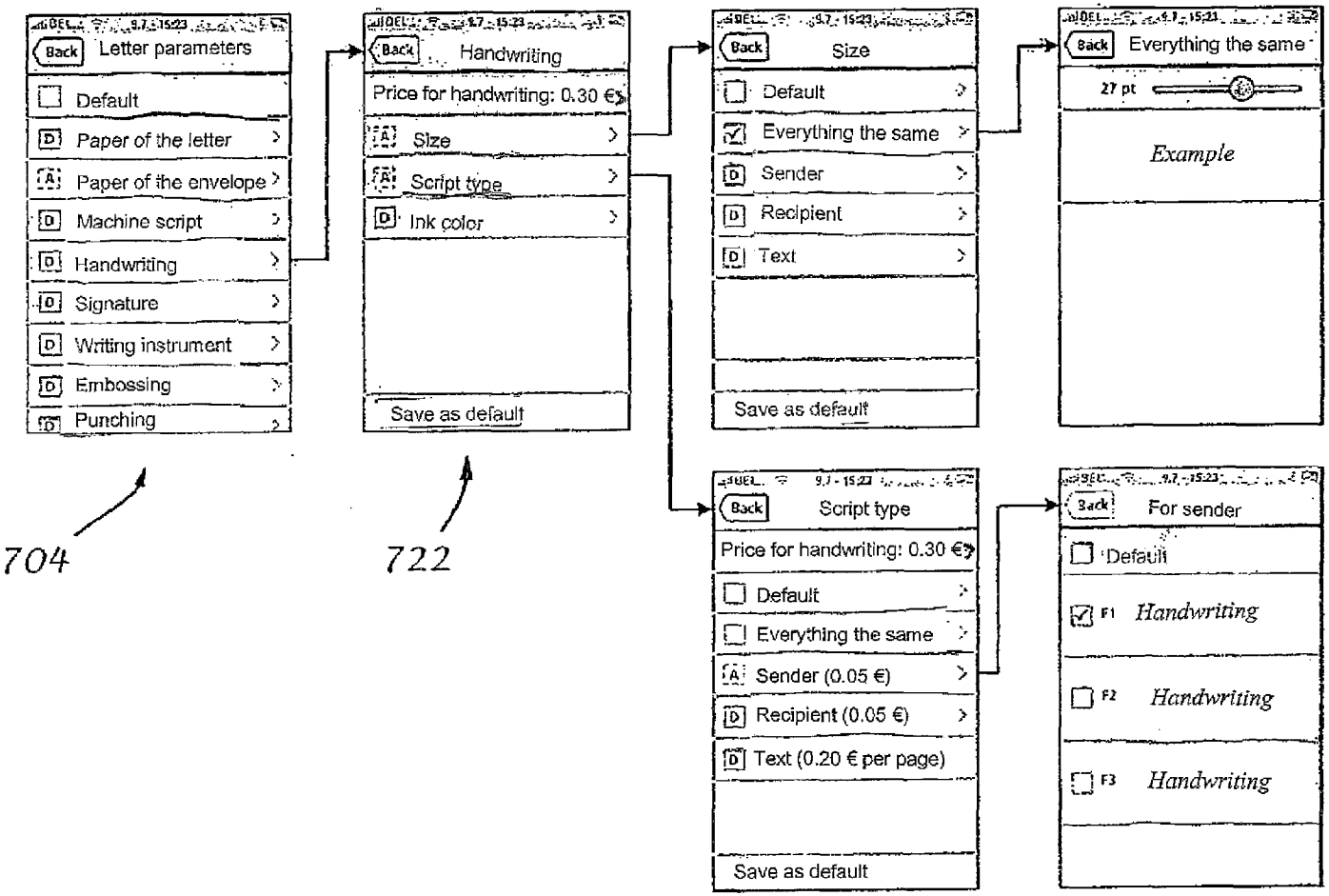
Figure 26:
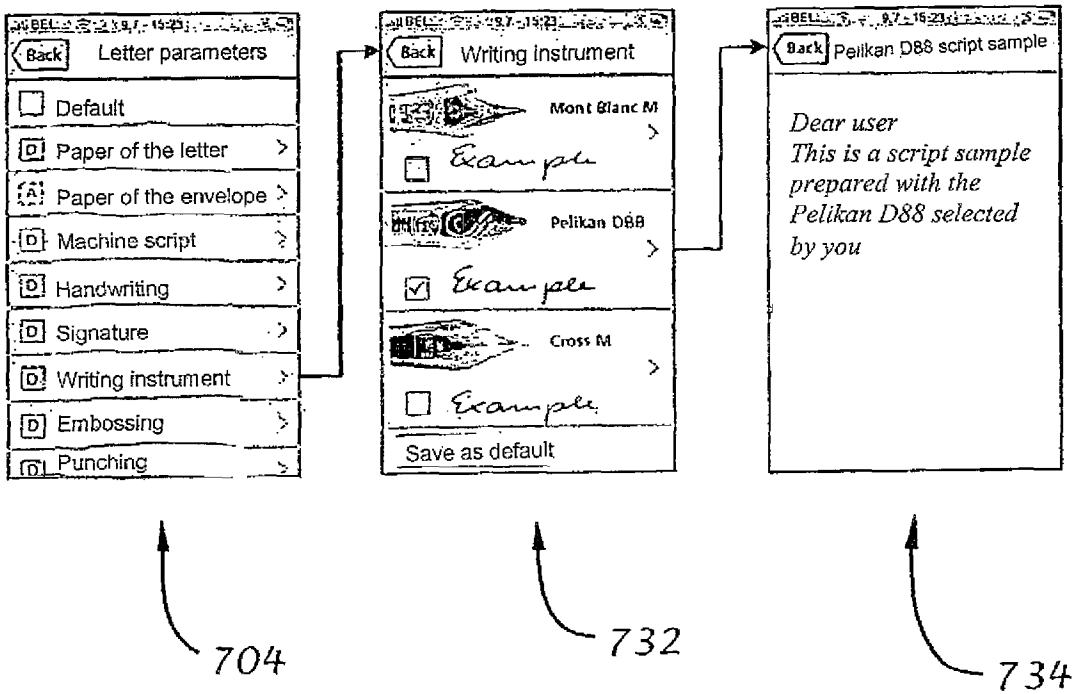
Figure 27:
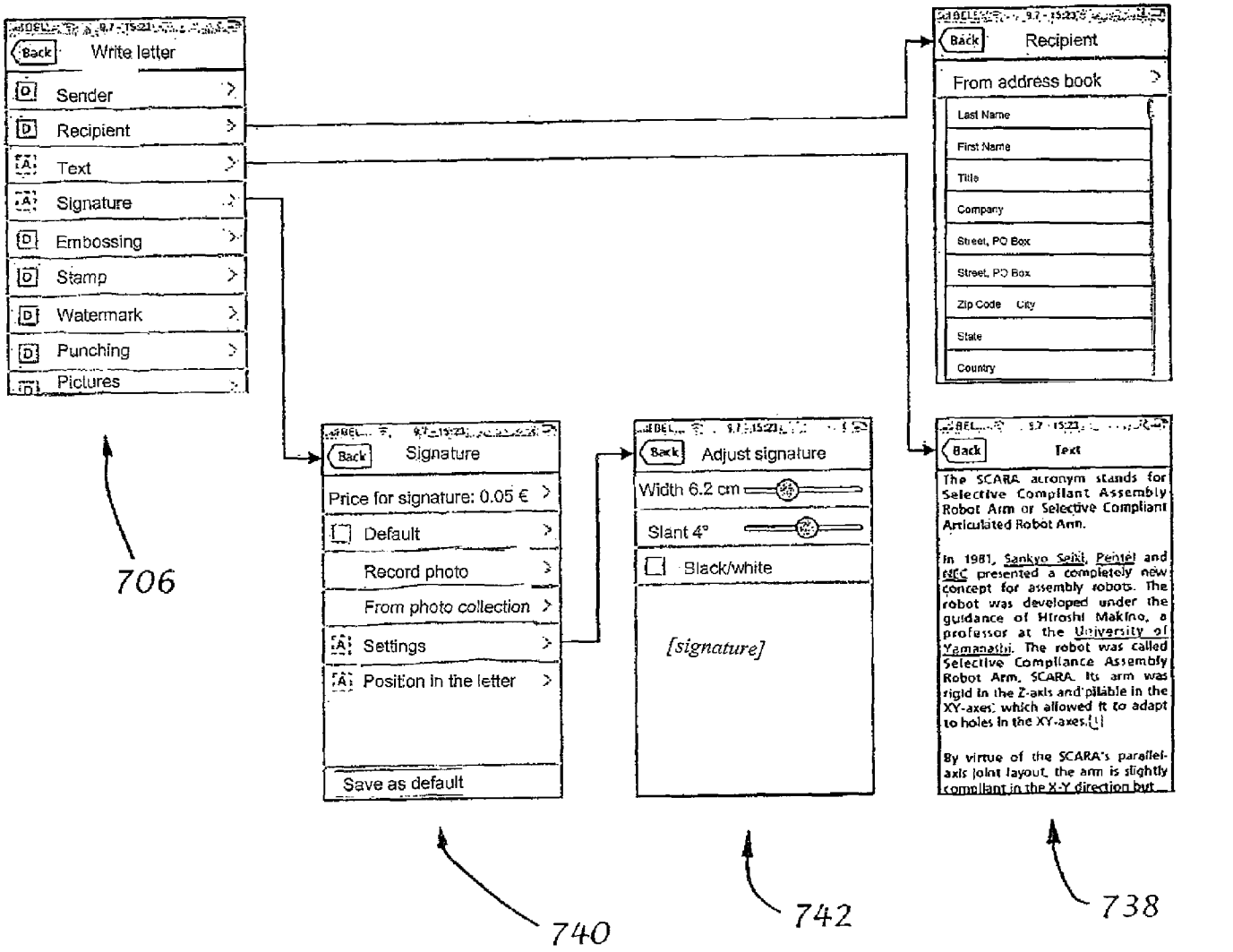
FIGS. 27 to 31 show an interface overview for the interface point "Write letter" according to FIG. 22.
Figure 28:
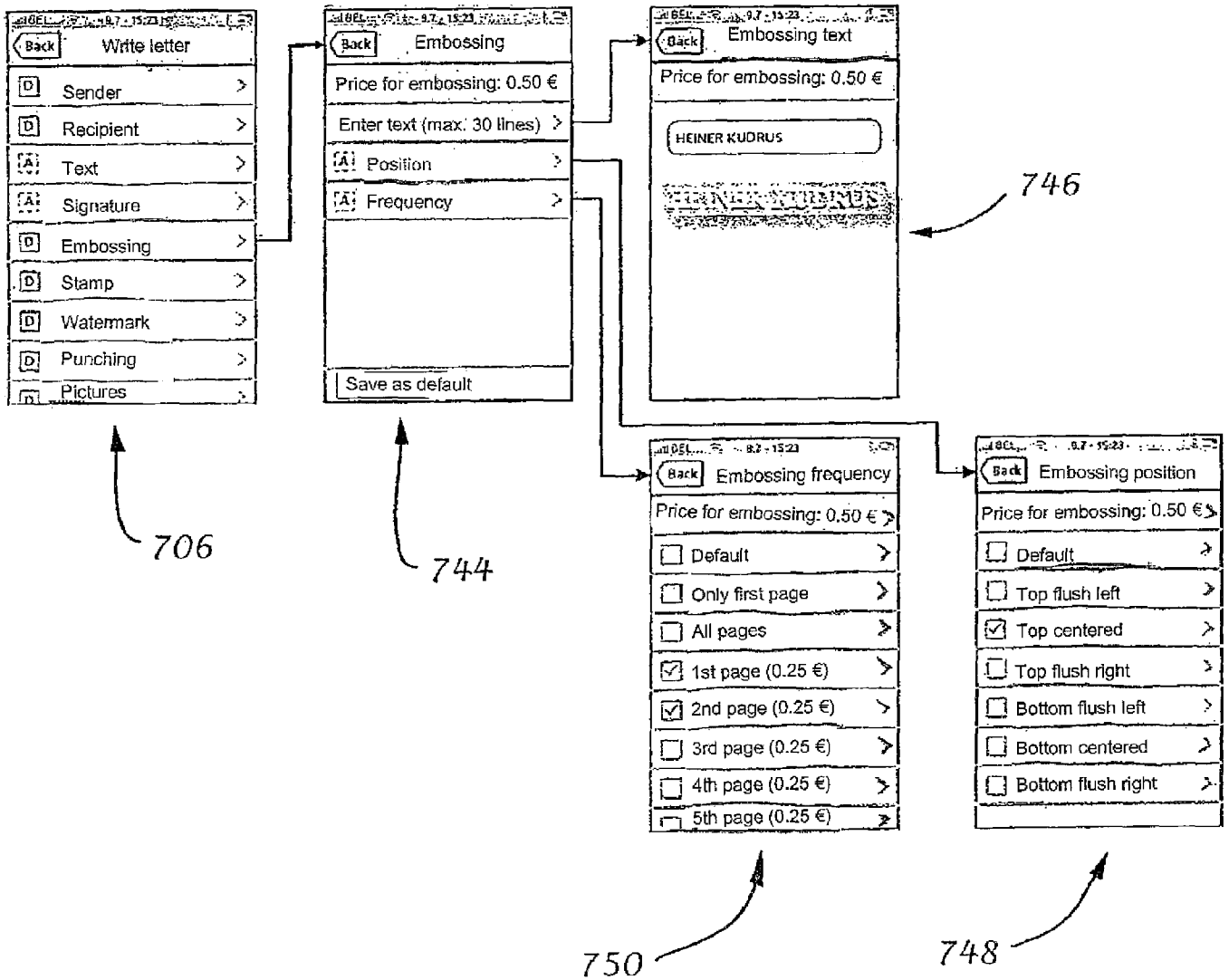
Figure 29:
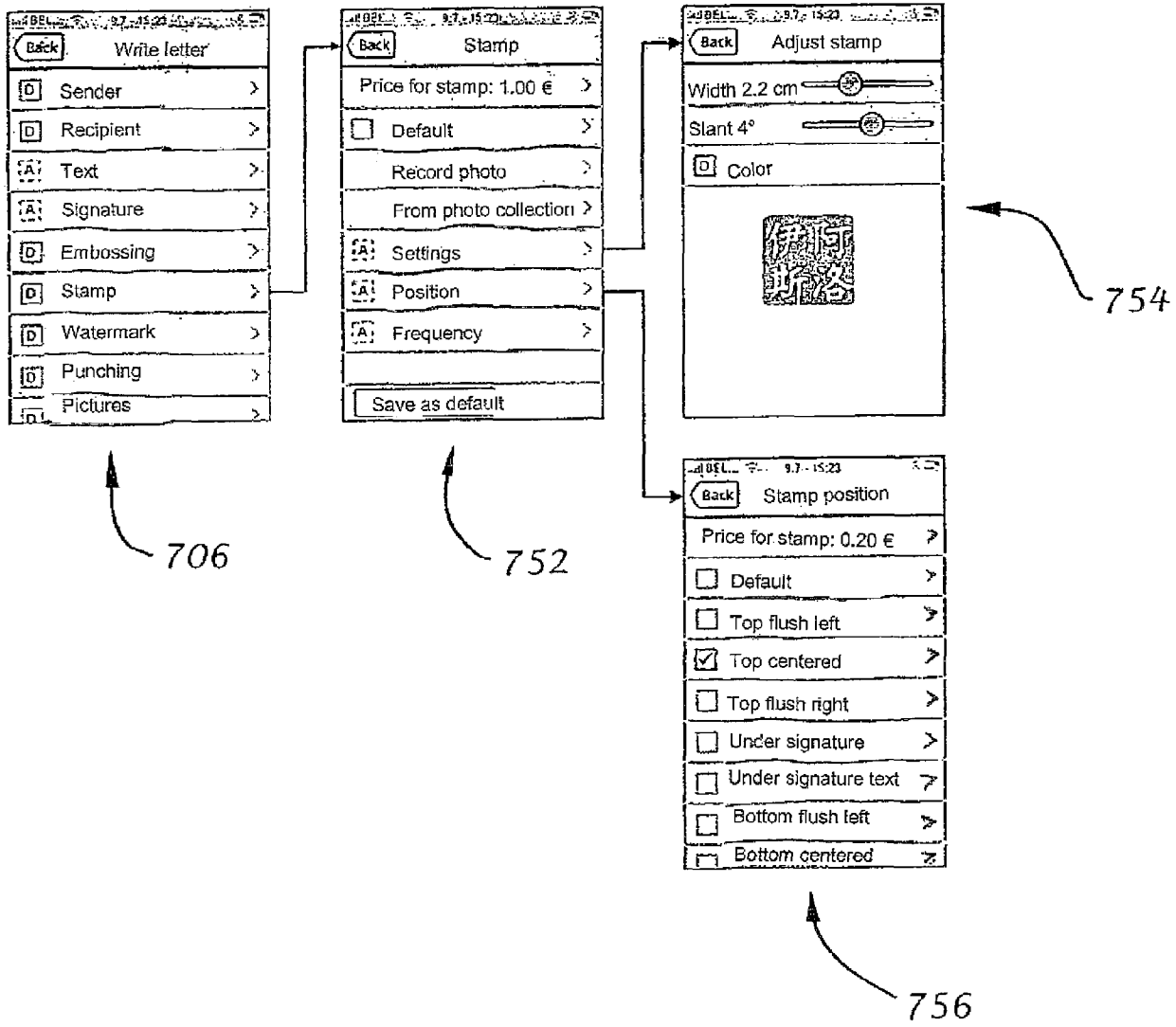
Figure 30:
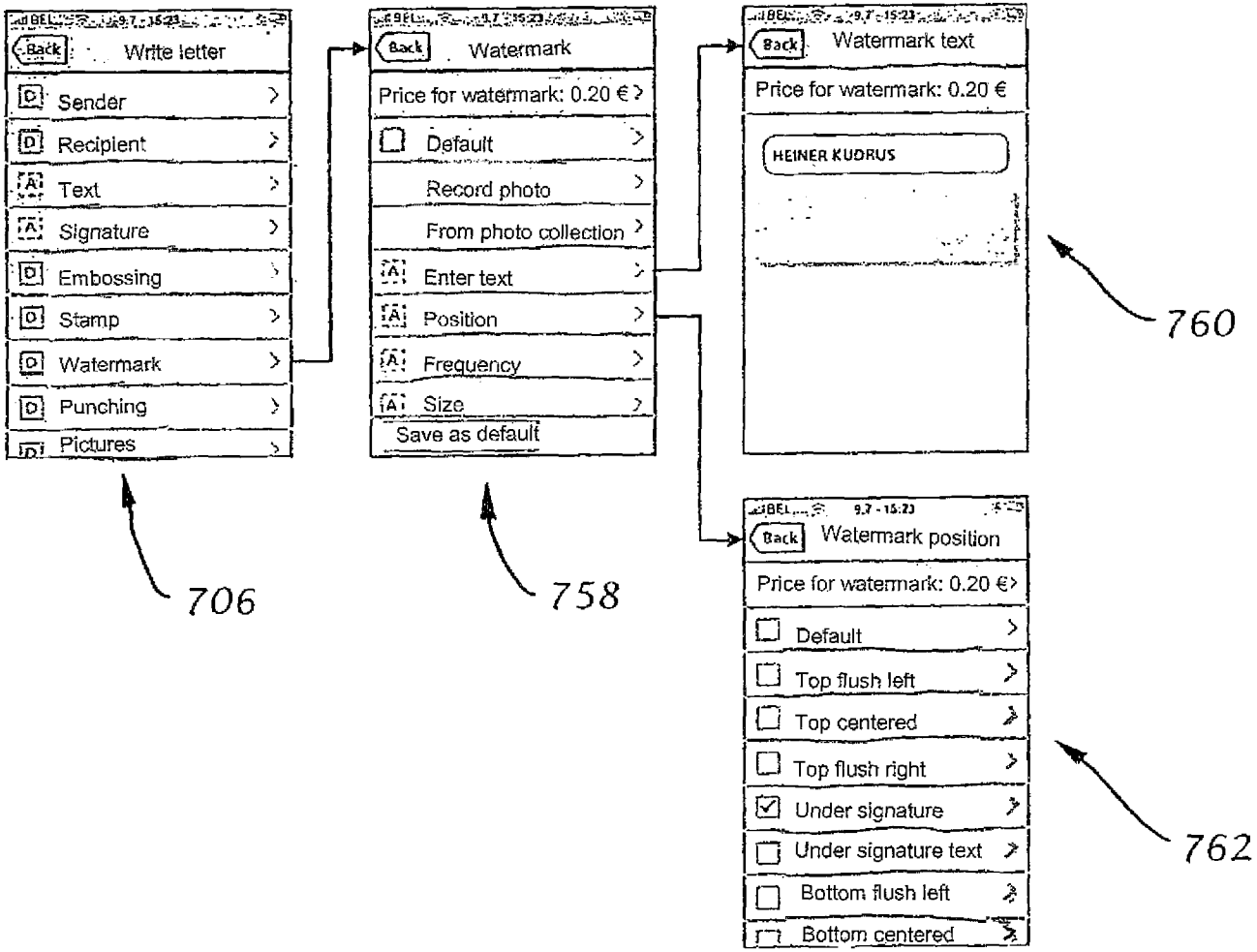
Figure 31:
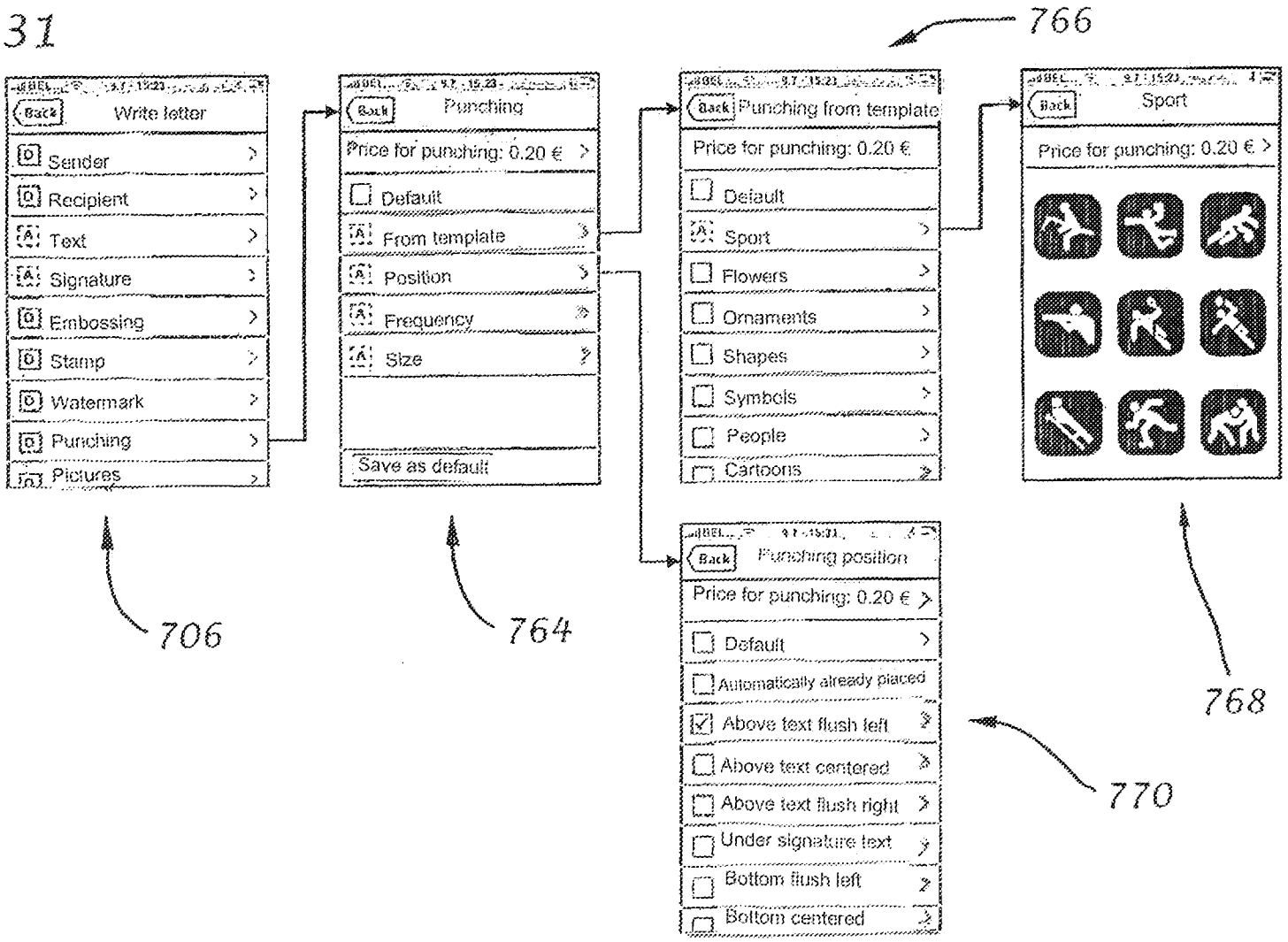

Detailed processes of a handwriting processing operation 600 and of a signature generation operation 630 are explained in more detail on the basis of the diagrams in FIGS. 20 and 21.

After the start of the handwriting processing operation 600, a handwriting query 602 first takes place, in which it is ascertained whether a personal handwriting is to be used. In the case of a positive handwriting query 602, a handwriting upload 604 as well as a script sample acquisition operation 606 takes place, in which the customer is able to transmit his or her own handwriting via the customer interface. The script sample acquisition operation 606 is followed immediately by a script sample analysis 608 and a handwriting optimization operation 610, in which the script of the customer or the individual characters are analyzed, optimized and if necessary modified. This ascertained handwriting or the ascertained character set of the handwriting is then saved as new character set in a character set generating system 612 and after a character set selection operation 614 is relayed to a character set transmission operation 626.

If a negative handwriting query 602 takes place within the handwriting processing operation 600, a script collection query 616 is started. In the case of a positive script collection query 616, a handwriting upload 618 likewise takes place, followed by a script sample comparison 620, which leads to a selection of a handwriting character set, similar to the customer's handwriting, from the script collection by means of the character set selection operation 622. Ultimately, if the script collection query 616 has taken place negatively, the customer has the option of a manual character set selection operation 624.

During the signature generation operation 630 in the process sequence according to FIG. 21, what takes place is optionally an individual signature or the possibility of selecting a signature from prepared character sets.

For the individual signature, firstly a signature upload 632 takes place. After the signature upload 632, a signature acquisition operation 634 as well as a signature analysis 636 takes place, in analogy to the script sample acquisition operation 606 and the script sample analysis 608. Corresponding to the signature analysis 636, a writing instrument control operation 644 may then be predefined.

For the possibility of selecting a signature from prepared character sets, firstly a writing instrument selection operation 638 takes place. Along with the writing instrument selection operation 638 a character set selection operation 640 is further initiated, as is also, after successful selection of the writing instrument as well as of the handwriting character set, a transmission operation 642 to the writing instrument, i.e. to the writing robot 110 or to a computer unit controlling it.

By means of the writing instrument control operation 644, the signature can then be executed in a signature execution operation 646 and the process described in FIG. 19 can be continued.

The structure of the customer interface 200 will be explained in more detail on the basis of FIGS. 22 to 32. In the primary level 700 according to FIG. 22, firstly the selection of several secondary interfaces takes place. The entire customer interface is set up as a parameter space or as a parameter matrix, in which the individual selectable secondary interfaces can be filed as a parameter vector with specific parameters. Thus, in addition to a preview 702, firstly a secondary interface for letter parameters 704 and for writing options 706, can be selected in the primary level 700.

In the letter parameters 704, various individual parameters, which likewise are arranged in several levels, can be selected according to FIGS. 23 to 26. Thus, for example, a secondary letter paper interface 708 can be selected, in which paper information 710 can be defined. Along with the selection of an option of a parameter, of which the paper information 710 represents one, a response is also sent immediately to the customer by means of a displayed price for the respective option in the graphical display of the customer interface 200. The total price of the order can be read in the main level 700.

Furthermore, the interface for the letter parameters 704 contains a sub-heading for a machine script 712. In this connection, information may be defined about a script option 714 as well as about a group allocation 716, whereby specific script parameters, such as bold or italic script, for example, can be selected either for an individual field of the letter, such as the sender or the recipient, for example, or for all fields together. In analogy to this, a script option 718 as well as a group allocation 720 for the typestyle of the selected text may take place within the interface for the machine script 712. If necessary, merely the specification of a file in a predefined format, which is able to activate a printer immediately may also take place at this location. In order to facilitate the operator control of the entire interface and to be able to handle repeated orders on the part of a customer better, it is possible to set the selected parameters in the respective secondary interfaces as standard parameters.

Along with the selection of a handwriting 722 or of a writing instrument option 732, the advantages according to the invention of the explained interface are brought to fruition, since in this connection the customer has the possibility of specifically selecting the processing device used for the processing operation. Thus, by means of the selection for the handwriting 722 and the writing instrument option 732, direct allocation takes place to a writing robot 110 or writing robot type, to which both handwriting options 724, 728 and also group allocations 726, 730 may be allocated. In addition, the group allocations 726 and 730 as well as a script sample 734 show the customer samples of the selected character sets.

Among the writing options 706, values for recipient data 736 and for a text 738 may further be added. The signature appended to the text is also defined via signature option 740 and selectable signature data 742. In this connection, both the saving of the selected signature as the standard value and also the return of a price for the respective signature option 740 are again immediately visible to the customer.

The necessary particulars for the method according to FIG. 19 are further defined under the writing options 706 according to FIGS. 28 to 31. Thus it is possible to select on the one hand an embossing option 744 with associated embossed text 746 and on the other hand an embossing position 748 as well as a number of embossings 750. Under the point for number of embossings 750, embossings for selected pages can be defined, whereas under the embossing position 748, the relative position of the selected embossing on the generated individual sheet can be defined.

In analogy to the embossing options 744, stamping options 752 and watermark options 758 can be defined together with an associated stamp position 756 or a watermark position 762. In contrast to the embossed text 746, a stamp pattern 754 or a watermark pattern 760 can be selected for a stamp or a watermark and, for the stamp pattern 754, the width, the slant or the color of the stamp can also be defined.

Furthermore, punching options 764 can also be defined among the writing options 706, wherein the punching option 764 has a punching selection 766 and a punching position 770, which in turn defines the relative position on the individual sheet. The punching selection 766 further includes preset punching patterns 768, while particulars of an individual customer's punching patterns could also be defined at this location.

Figure 32:
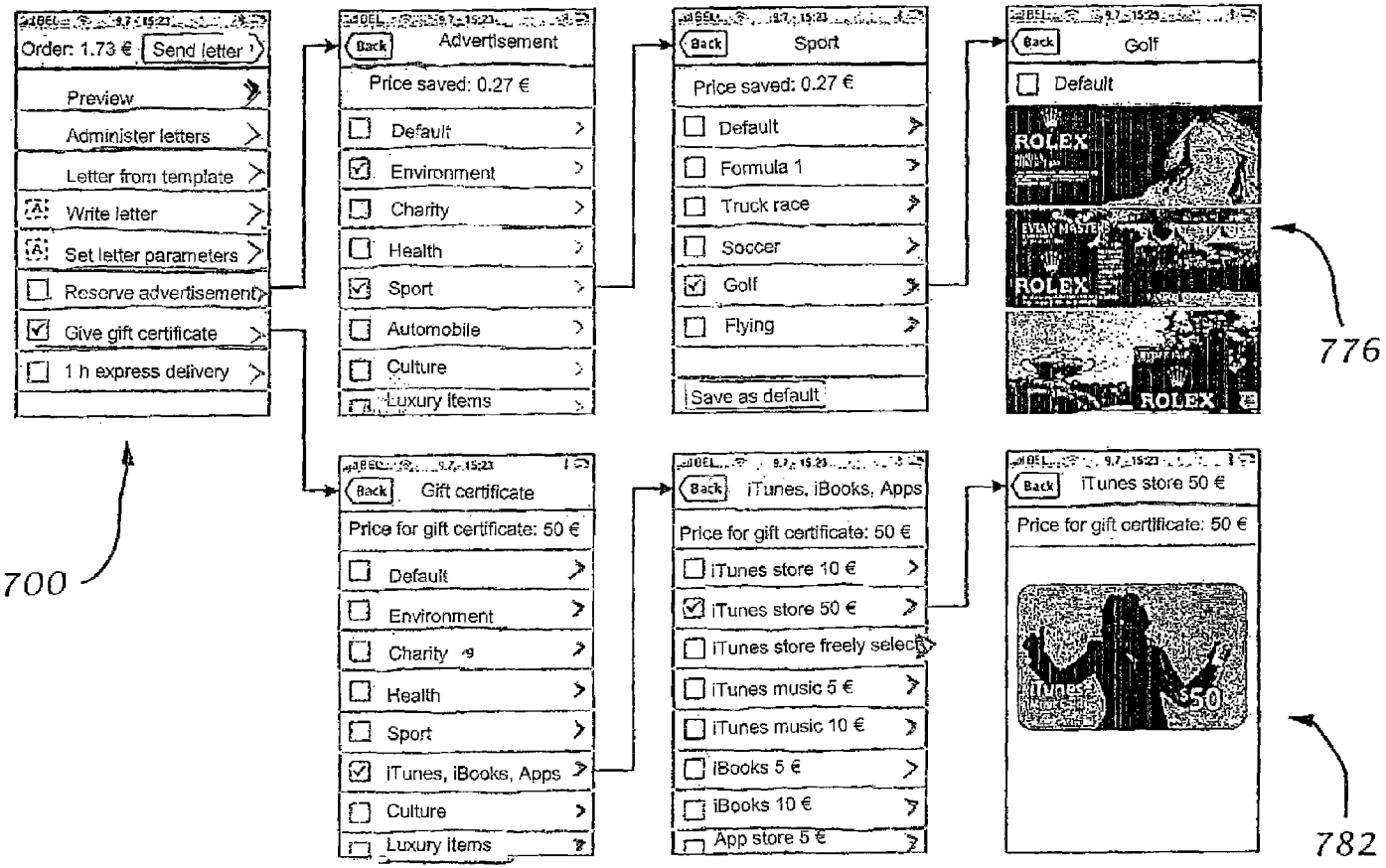
FIG. 32 shows a further schematic overview of the interface according to FIG. 22.
Figure 33:
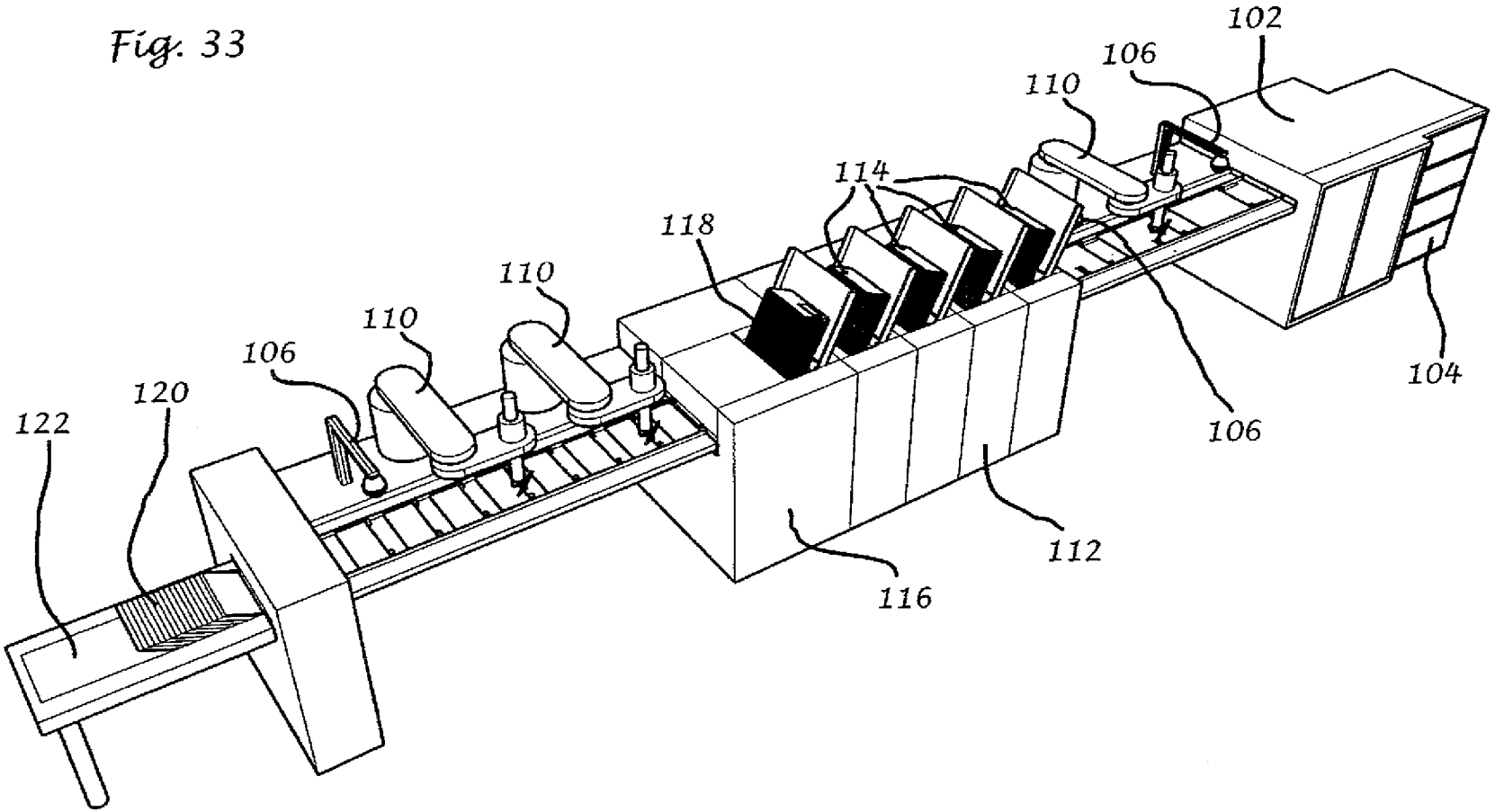
FIG. 33 shows an alternative processing machine for the creation of written documents in overall view.
Figure 34:
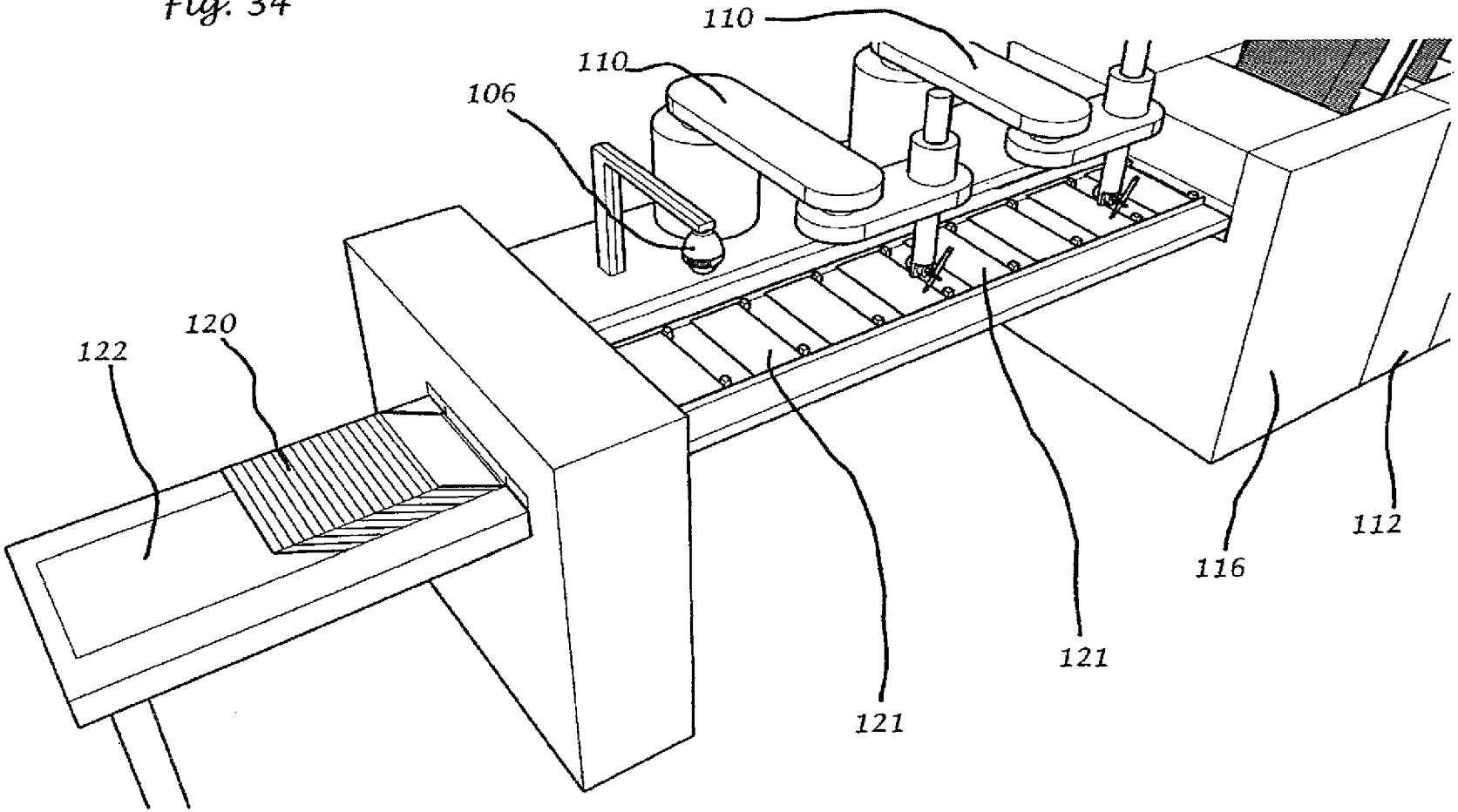
FIG. 34 shows a detail view of the processing machine according to FIG. 33.

Besides the parameters described hereinabove for the customer interface 200, advertising options 772 and gift certificate options 778 can be activated in addition to sending options in the primary level 700 according to FIG. 32. Thus it is possible on the one hand, by means of the selected advertising option 772, to lower the price of a written document via an advertisement selected in an advertising selection 774, where a specific choice of advertising pictures 776 can be made, and on the other hand, for example for festive occasions, to select gift certificates for the recipient by means of a gift certificate selection operation 780 and associated gift certificate pictures 782. In this respect the customer interface 200 includes further advantageous configurations according to the invention, since besides the precisely scheduled sending of the individual written document, payments are prepared for the recipient, while the client—not only at great distance from the recipient—is able to send messages and gifts with great savings of time and costs.

It will be understood in this connection that all options of the customer interface and process steps of letter processing shown on the basis of the figures do not necessarily have to be implemented cumulatively. Thus, for the purpose of simple operator control by the customer and execution of the process, individual parameters of the customer interface may also be omitted, as may process steps. Likewise further supplementary process steps may be provided without difficulty. It is also possible to modify individual process steps in order, for example, to adapt them appropriately with respect to their convenience for the operators but also to the requirements due to the individual processing stations.

LIST OF REFERENCE NUMERALS

| | |
|---|---|
| 100 | Processing machine |
| 101 | Separating device |
| 102 | Printer |
| 103 | Endless paper roll |
| 104 | Paper supply |
| 106 | Camera |
| 108 | Cutting robot |
| 110 | Writing robot |
| 111 | Tool magazine |
| 112 | Enclosure feeder |
| 114 | Enclosure |
| 116 | Inserter |
| 118 | Envelope |
| 120 | Written document ready for sending |
| 121 | Envelope and flat item |
| 122 | Deposition belt |
| 130 | Letter paper |
| 132 | Conveyor belt |
| 134 | Follower |
| 136 | Cutting head |
| 138 | Cutout |
| 140 | Stylus |
| 141 | Brush |
| 142 | Ink reservoir |
| 144 | Filling tube |
| 146 | Spray head |
| 148 | Pneumatic tube |
| 150 | Embossing machine |
| 152 | Servomotor |
| 154 | Toothed gear |
| 156 | Toothing |
| 158 | Embossing cylinder |
| 160 | Bearing block |
| 162 | Embossing wheel |
| 164 | Embossing rim |
| 166 | Positive typeface |
| 168 | Negative typeface |
| 170 | Typeface carrier |
| 180 | Stamping robot |
| 182 | Stamp |
| 184 | Dye station |
| 186 | Cleaning station |
| 188 | Dye head |
| 190 | Sheet card |
| 192 | Turning station |
| 194 | Tray |
| 200 | Customer interface |
| 202 | Input unit |
| 204 | Network connection |
| 206 | Network |
| 208 | Central mail center |
| 210 | Decentralized mail center |
| 212 | Order administration |
| 214 | Central computer |
| 216 | Production computer |
| 218 | Processing machine |
| 220 | Written document ready for sending |
| 222 | Sending region |
| 230 | Order start |
| 232 | Data record generation |
| 234 | Data record sending |
| 236 | Status display |
| 240 | User query |
| 242 | Registration |
| 244 | Data record allocation |
| 246 | Data record sending |
| 248 | Invoice creation |
| 250 | Invoice sending |
| 260 | User query |

-continued

| | |
|---|---|
| 262 | Sample letter generation |
| 264 | Sample letter sending |
| 266 | Letter creation |
| 268 | Letter sending |
| 270 | Picture query |
| 272 | Status report |
| 274 | Status report |
| 300 | Data record distribution |
| 302 | Data record reception |
| 304 | Recipient identification |
| 306 | Recipient query |
| 308 | Recipient allocation |
| 310 | Recipient query |
| 312 | Recipient allocation |
| 314 | Recipient allocation |
| 316 | Data record consolidation |
| 318 | Data record transmission |
| 400 | Order processing |
| 402 | Data record reception |
| 404 | Order planning |
| 406 | Order transmission |
| 408 | Order relaying |
| 410 | Individual sheet generation |
| 412 | Picture query |
| 414 | Cover sheet query |
| 416 | Picture generation |
| 418 | Picture generation |
| 420 | Picture transmission |
| 422 | Order relaying |
| 424 | Advertising query |
| 426 | Advertisement generation |
| 428 | Gift certificate query |
| 430 | Gift certificate generation |
| 432 | Insertion |
| 434 | Picture query |
| 436 | Picture transmission |
| 438 | Envelope output |
| 500 | Order processing |
| 502 | Data record reception |
| 504 | Order planning |
| 506 | Order transmission |
| 508 | Order relaying |
| 510 | Single sheet generation |
| 512 | Printing query |
| 514 | Printing |
| 516 | Writing script query |
| 518 | Script creation |
| 520 | Signature query |
| 522 | Signature generation |
| 524 | Embossing query |
| 526 | Embossing |
| 528 | Punching query |
| 530 | Punching |
| 532 | Stamping query |
| 534 | Stamping |
| 536 | Watermark query |
| 538 | Watermark generation |
| 540 | Sheet query |
| 542 | Status communication |
| 600 | Handwriting processing |
| 602 | Handwriting query |
| 604 | Handwriting upload |
| 606 | Script sample acquisition |
| 608 | Script sample analysis |
| 610 | Handwriting optimization |
| 612 | Character set generation |
| 614 | Character set selection |
| 616 | Script collection query |

-continued

| | |
|---|---|
| 618 | Handwriting upload |
| 620 | Script sample comparison |
| 622 | Character set selection |
| 624 | Manual character set selection |
| 626 | Character set transmission |
| 630 | Signature generation |
| 632 | Signature upload |
| 634 | Signature acquisition |
| 636 | Signature analysis |
| 638 | Writing instrument selection |
| 640 | Character set selection |
| 642 | Writing instrument transmission |
| 644 | Writing instrument control |
| 646 | Signature execution |
| 700 | Primary level |
| 702 | Preview |
| 704 | Letter parameters |
| 706 | Writing options |
| 708 | Letter parameters |
| 710 | Paper information |
| 712 | Machine script |
| 714 | Script options |
| 716 | Group allocation |
| 718 | Script options |
| 720 | Group allocation |
| 722 | Handwriting |
| 724 | Handwriting options |
| 726 | Group allocation |
| 728 | Handwriting options |
| 730 | Group allocation |
| 732 | Writing instrument options |
| 734 | Script sample |
| 736 | Recipient data |
| 738 | Text |
| 740 | Signature options |
| 742 | Signature data |
| 744 | Embossing options |
| 746 | Embossed text |
| 748 | Embossing position |
| 750 | Number of embossings |
| 752 | Stamping option |
| 754 | Stamping pattern |
| 756 | Stamping position |
| 758 | Watermark options |
| 760 | Watermark pattern |
| 762 | Watermark position |
| 764 | Punching options |
| 766 | Punching selection |
| 768 | Punching pattern |
| 770 | Punching position |
| 772 | Advertising options |
| 774 | Advertising selection |
| 776 | Advertising picture |
| 778 | Gift certificate options |
| 780 | Gift certificate selection |
| 782 | Gift certificate picture |

The invention claimed is:

1. Device for creating and sending flat articles, comprising an electronic order processing system and a processing machine, which is activated by the electronic order processing system and which comprises a printing machine and a mechanical sending preparation system, wherein the printing machine comprises a locally active and/or stationary written document preparation system; and wherein the printing machine comprises a further printing device and the locally active and/or stationary written document preparation system is disposed between the further printing device and the mechanical sending preparation system.

2. Device according to claim 1, wherein the printing machine and the mechanical sending preparation system have allocating means for the allocation of a flat article to a specific order.

3. Device according to claim 1, wherein the mechanical sending preparation system comprises an envelope-inscribing device.

4. Device according to claim 3, wherein the preparation system comprises a locally active and/or stationary written document preparation system.

5. Device according to claim 1, wherein the written document preparation system comprises vectorially activated tool control system.

6. Device according to claim 1, wherein the written document preparation system comprises a three-dimensional tool control system.

7. Device according to claim 6, wherein a substantially one-dimensionally active tool is disposed on the three-dimensional tool control system.

8. Device according to claim 7, wherein the one-dimensionally active a stylus, a brush, a pen, a knife, a spray head and/or a stamp.

9. Device according to claim 1, wherein the written document preparation system comprises a tool magazine.

10. Device according to claim 1, wherein the written document preparation system comprises an embossing station.

11. Device according to claim 1, wherein a picture recording system is disposed in the area of the written document preparation system or behind it.

12. Device according to claim 1, wherein written document preparation system at best two identically constructed processing devices.

13. Device according to claim 12, wherein a distributor is disposed between an entry, between the printing machine, and the two processing stations.

14. Device according to claim 12, wherein the two processing devices have a common entry and/or a common exit.

15. Device according to claim 1 further comprising at least two processing devices, wherein the two processing devices are respectively identical and/or are two different locally active and/or stationary written document preparation systems.

16. Device according to claim 15, wherein the two identical locally active and/or stationary written document preparation systems are activated in dual stream mode.

17. Device according to claim 15, wherein the flat articles comprise written documents or printed matter.

18. Device according to claim 1, wherein the flat articles comprise written documents or printed matter.

19. Device for creating and sending flat articles comprising an electronic order processing system and a processing machine, which is activated by the electronic order processing system and which comprises least two processing devices, wherein an interface is disposed between the electronic order processing system and a customer, wherein the interface contains a parameter matrix with at least two parameter vectors, wherein the first of the two parameter vectors includes parameters for a first processing instruction for a fiat article or the written document and a second of the two parameter vectors includes parameters for a second processing instruction for the flat article or the written document.

20. Device according to claim 19, wherein the parameters contain processing instructions for a script, a watermark, a stamp, an embossing, a punching, a fragrance, a letter pacer a letter envelope, pictures or advertising.

21. Device according to claim 19, wherein the two parameter vectors have at least one different processing instruction for various processing steps.

22. Device according to claim 21, wherein the various processing steps are printing instructions.

23. Device according to claim 19, wherein the first of the two parameter vectors has processing instructions for the activation of the first of the two processing devices and the second of two parameter vectors has processing instructions for the activation of the second of the two processing devices.

24. Device according to claim 19, wherein the flat articles comprise written documents or printed matter.

* * * * *